US009061875B2

(12) United States Patent
Sano et al.

(10) Patent No.: US 9,061,875 B2
(45) Date of Patent: Jun. 23, 2015

(54) DRINKING WATER DISPENSER

(75) Inventors: Kazutoshi Sano, Fuji (JP); Hiroshi Fushimi, Fuji (JP)

(73) Assignee: PURPOSE CO., LTD., Fuji-shi (JP)

( * ) Notice: Subject to any disclaimer, the term of this patent is extended or adjusted under 35 U.S.C. 154(b) by 0 days.

(21) Appl. No.: 13/524,080

(22) Filed: Jun. 15, 2012

(65) Prior Publication Data

US 2012/0248141 A1 Oct. 4, 2012

Related U.S. Application Data

(63) Continuation of application No. PCT/JP2010/001238, filed on Feb. 24, 2010.

(51) Int. Cl.

| | |
|---|---|
| ***B67D 1/00*** | (2006.01) |
| ***B67D 7/14*** | (2010.01) |
| ***B67D 3/00*** | (2006.01) |

(52) U.S. Cl.

CPC ..... *B67D 3/0022* (2013.01); *B67D 3/0003* (2013.01); *B67D 3/0009* (2013.01); *B67D 3/0032* (2013.01)

(58) Field of Classification Search

CPC .. B67D 3/0022; B67D 3/0003; B67D 3/0009; B67D 3/0032

USPC ..... 222/67, 52, 54, 62; 137/409, 434, 448

See application file for complete search history.

(56) References Cited

U.S. PATENT DOCUMENTS

| | | | | |
|---|---|---|---|---|
| 2,019,034 | A * | 10/1935 | Alex | 62/397 |
| 2,062,423 | A * | 12/1936 | Mingus et al. | 137/448 |
| 3,915,341 | A * | 10/1975 | Brown | 222/67 |
| 4,958,747 | A * | 9/1990 | Sheets | 222/67 |
| 5,111,966 | A * | 5/1992 | Fridman | 222/1 |
| 5,611,459 | A * | 3/1997 | Hinch | 222/67 |
| 6,588,630 | B2 * | 7/2003 | Tan et al. | 222/185.1 |
| 7,117,685 | B2 * | 10/2006 | Wetherbee | 62/115 |

(Continued)

FOREIGN PATENT DOCUMENTS

| | | |
|---|---|---|
| CN | 2324142 Y | 6/1999 |
| CN | 1792304 A | 6/2006 |

(Continued)

OTHER PUBLICATIONS

Sano et al., JP 2009196650 A, Sep. 2009—English Machine Translation.*

(Continued)

*Primary Examiner* — J. Casimer Jacyna
*Assistant Examiner* — Benjamin R Shaw
(74) *Attorney, Agent, or Firm* — Westerman, Hattori, Daniels & Adrian, LLP

(57) ABSTRACT

A drinking water dispenser heats and cools drinking water supplied from a water supply bottle, and provides heated and cooled drinking water. The dispenser includes a cold water tank, a hot water tank, a water supply pipe, a valve, a by-pass pipe, a by-pass valve and a control unit. The valve opens and closes a water outlet for taking in the drinking water from the water supply bottle according to a level of the drinking water in the cold water tank, limits supply of the drinking water to the cold water tank, and, while the water outlet is shut, suppresses convection of the drinking water and/or heat of the drinking water between the water supply bottle and the cold water tank.

11 Claims, 20 Drawing Sheets

(56) References Cited

U.S. PATENT DOCUMENTS

| | | | | |
|---|---|---|---|---|
| 2005/0006405 | A1* | 1/2005 | Tang | 222/146.6 |
| 2012/0055953 | A1 | 3/2012 | Shiotani et al. | |

FOREIGN PATENT DOCUMENTS

| | | | | |
|---|---|---|---|---|
| CN | 102365228 | A | | 2/2012 |
| EP | 2415705 | A1 | | 2/2012 |
| JP | 01-134098 | U | | 9/1989 |
| JP | 2003-128194 | A | | 5/2003 |
| JP | 2005-249266 | A | | 9/2005 |
| JP | 2005-308297 | A | | 11/2005 |
| JP | 2006-176179 | A | | 7/2006 |
| JP | 2006176179 | A | * | 7/2006 |
| JP | 2007-57219 | A | | 3/2007 |
| JP | 3141387 | U | * | 5/2008 |
| JP | 2009-046150 | A | | 3/2009 |
| JP | 4317262 | B1 | | 8/2009 |
| JP | 2009-196650 | A | | 9/2009 |
| JP | 2009196650 | A | * | 9/2009 |
| JP | 2010-228807 | A | | 10/2010 |
| KR | 10-2006-0073462 | A | | 6/2006 |
| KR | 10-2012-0001758 | A | | 1/2012 |
| WO | 2010/116544 | A1 | | 10/2010 |

OTHER PUBLICATIONS

Watanabe et al., JP 2006176179 A, Jul. 2006—English Machine Translation.*

Sano et al., JP 3141387 U, May 2008—English Machine Translation.*

JP 3141387 U—English Translation.*

International Search Report of PCT/JP2010/001238, mailing date of Apr. 27, 2010.

Japanese Written Opinion of PCT/JP2010/001238, mailing date of Apr. 27, 2010.

English translation of the International Preliminary Report on Patentability (Form PCT/IB/338) mailed Sep. 27, 2012 (1 page), an English translation of the Written Opinion of the International Searching Authority (Form PCT/ISA/237) dated Apr. 27, 2010 (5 pages) and Form PCT/IB/373 (1 page).

Chinese Office Action dated Jun. 27, 2013, issued in corresponding Chinese Patent Application No. 201080064128.4, w/partial English translation.

Korean Office Action dated Jan. 15, 2014, issued in corresponding Korean Patent Application No. 10-2012-7014259 (U.S. Appl. No. 13/524,080), w/English translation, (7 pages).

Chinese Office Action dated Feb. 12, 2014, issued in corresponding Chinese Patent Application No. 201080064128.4 (U.S. Appl. No. 13/524,080), w/English translation, (9 pages).

Chinese Office Action dated Jul. 28, 2014, issued in corresponding Chinese Application No. 201080064128.4; w/English Translation. (11 pages).

Chinese Office Action dated Feb. 12, 2015, issued in corresponding CN Patent Application No. 201080064128.4 with English translation of relevant portions (10 pages).

* cited by examiner

DRINKING WATER DISPENSER

CROSS-REFERENCE TO RELATED APPLICATIONS

This application is a continuation application of International Application No. PCT/JP2010/001238, filed on Feb. 24, 2010, the contents of which are hereby incorporated by reference.

BACKGROUND OF THE INVENTION i) Field of the Invention

The present invention relates to a drinking water dispenser that cools drinking water provided by the bottle to dispense cold water, or heats the drinking water to dispense hot water.

ii) Description of the Related Art

A drinking water dispenser (water dispenser) for cooling or heating, and dispensing drinking water, such as mineral water, supplied from a bottle is commonly used. For example, this drinking water dispenser is used for drinking water supply not only in an office but also in a home.

It is known concerning such a drinking water dispenser that drinking water heated in a hot water tank is circulated in a cold water tank (for example, Japanese Laid-Open Patent Publications No. 2005-249266 and 2009-046150).

It is also known that convection of water or temperature is suppressed between a bottle which supplies drinking water and a cold water tank (for example, Japanese Laid-Open Patent Publication No. 2009-196650).

BRIEF SUMMARY OF THE INVENTION

When purification of drinking water is carried out with circulation of water, which is heated in a hot water tank, in a cold water tank of a drinking water dispenser using, e.g., natural convection, complication of a circulation route for the water causes the circulation rate to decrease, which necessitates a long time for the purification.

When a circulation route of drinking water in a drinking water dispenser is simplified and, e.g., a bottle for supplying drinking water is made to approach a cold water tank, there is a risk of heated drinking water, which circulates in the cold water tank, and its heat convecting to drinking water of room temperature in the bottle.

An object of the drinking water dispenser of the present disclosure is, in a purification process, to prevent drinking water in a bottle from being heated by convection of heated drinking water or its heat to the bottle.

Another object of the drinking water dispenser of the present disclosure is to prevent a purification function from deteriorating due to heated drinking water convecting to drinking water in a bottle to lower the temperature of circulating drinking water.

The drinking water dispenser of the present disclosure is a drinking water dispenser that heats and cools drinking water supplied from a water supply bottle, and provides heated and cooled drinking water, and that includes a cold water tank, a hot water tank, a water supply pipe, a valve, a by-pass pipe, a by-pass valve and a control unit. The cold water tank cools the drinking water to store the cooled drinking water. The hot water tank heats the drinking water to store the heated drinking water. The water supply pipe introduces the drinking water supplied to the cold water tank, to the hot water tank. The valve opens and closes a water outlet for taking in the drinking water from the water supply bottle according to a level of the drinking water in the cold water tank, limits supply of the drinking water to the cold water tank, and, while the water outlet is shut, suppresses convection of the drinking water and/or heat of the drinking water between the water supply bottle and the cold water tank. The by-pass pipe is between the hot water tank and the cold water tank, along with the water supply pipe, to circulate the heated drinking water in the hot water tank and the cold water tank. The by-pass valve blocks the by-pass pipe. The control unit controls open and close of the by-pass valve while there is no provision request of the drinking water and while the valve is shut.

The drinking water dispenser of the present invention may further include cooling means, heating means, cold water temperature detecting means and hot water temperature detecting means. The cooling means is placed on the cold water tank, and cools the drinking water. The heating means is placed on the hot water tank, and heats the drinking water. The cold water temperature detecting means detects a temperature of the drinking water in the cold water tank. The hot water temperature detecting means detects a temperature of the drinking water in the hot water tank. When the drinking water is circulated, the control unit may stop the cooling means and operate the heating means to heat the drinking water to a predetermined temperature or over.

The drinking water dispenser of the present invention may further include a separating plate. The separating plate separates the drinking water in the cold water tank into an upper layer side and a lower layer side. The water supply pipe may be connected to an opening of the separating plate, and make the drinking water, that falls onto the separating plate from the water outlet, flow to the hot water tank.

In the drinking water dispenser of the present invention, the valve may further include a float part and an open and close part. The float part rises and falls according to the level of the drinking water in the cold water tank. The open and close part is placed on the float part and opens and closes the water outlet. An air layer may be formed between the water outlet and a water surface of the cold water tank of a full level by shutoff of the water outlet.

In the drinking water dispenser of the present invention, the float part and the open and close part may be formed by a ball tap.

The drinking water dispenser of the present invention may further include a water level detector. The water level detector detects the level of the drinking water in the cold water tank. The valve may be formed by an open and close valve that opens and closes the water outlet. The control unit may open and close the open and close valve according to a result of detection of the water level detector.

Other objects, features and advantages of the present invention will become clearer with reference to attached drawings and each embodiment.

DETAILED DESCRIPTION OF THE INVENTION

First Embodiment

According to a first embodiment, a purification process is carried out in a drinking water dispenser with heating and circulating drinking water in the drinking water dispenser during a predetermined timing. The drinking water dispenser provides a valve that limits supply of drinking water according to the water level, and that, in a purification process, suppresses an inflow of the drinking water and convection of heat to a bottle.

Figure 1:
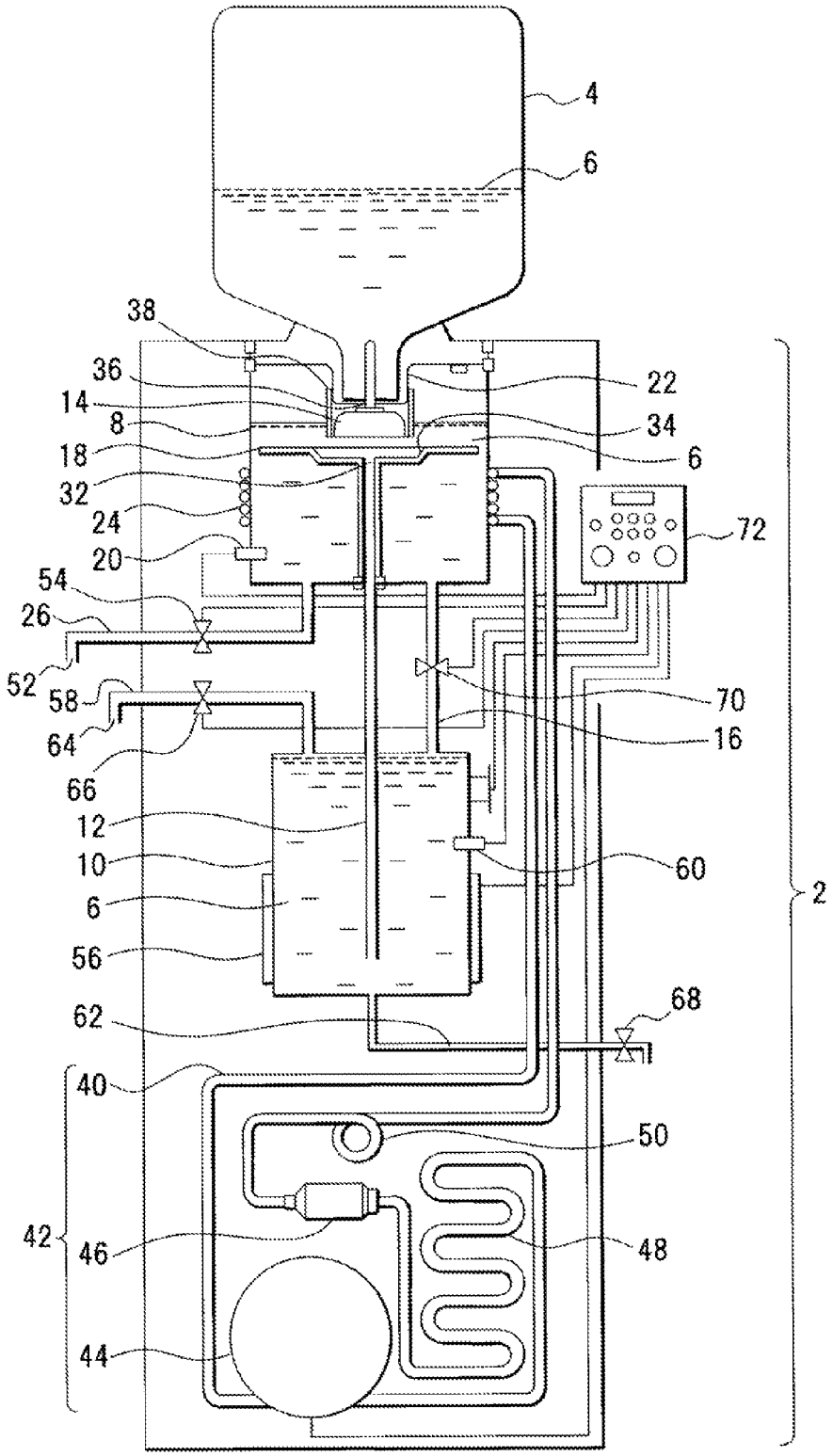
FIG. 1 depicts an example of an internal structure of a drinking water dispenser according to a first embodiment.
Figure 2:
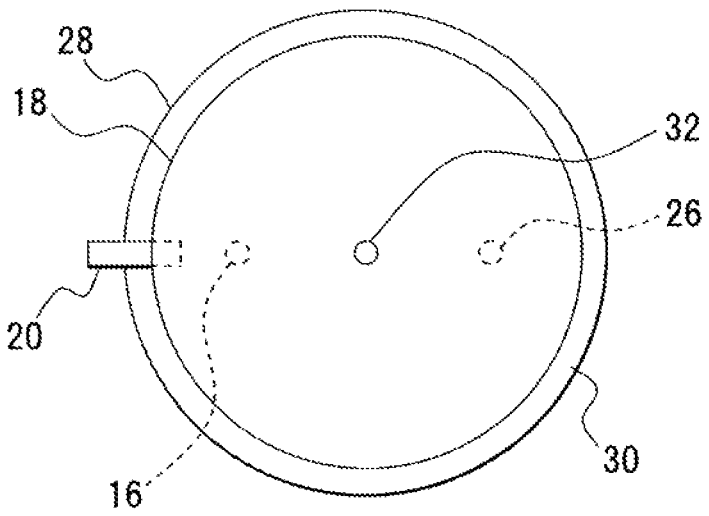
FIG. 2 depicts an example illustrating a cold water tank from a top view.

The first embodiment will be described with reference to FIGS. 1 and 2. FIG. 1 depicts an example of an internal structure of the drinking water dispenser according to the first embodiment, and FIG. 2 depicts an example illustrating a cold water tank from a top view. Each structure depicted in FIGS. 1 and 2 is an example, and is not limited to this example.

A drinking water dispenser 2 is an example of the drinking water dispenser of the present disclosure. The drinking water dispenser 2 receives supply of drinking water 6 from a bottle 4, and cools the drinking water 6 to provide cold water or heats the drinking water 6 to provide hot water. This drinking water dispenser 2 includes, for example, the bottle 4, a cold water tank 8, a hot water tank 10, a water supply pipe 12, a separator float 14 and a by-pass pipe 16.

The bottle 4 is an example of a supplying means of drinking water to the drinking water dispenser 2. For example, the bottle 4 is mounted on the top of the drinking water dispenser 2, and supplies the drinking water 6 to the cold water tank 8 using a difference in height. The separator float 14 is opened and closed as described below, which causes the supply of the drinking water 6 from the bottle 4 to the cold water tank 8 to be limited to a predetermined water level in the cold water tank 8.

The cold water tank 8 is an example of a means for cooling and storing the drinking water 6 supplied from the bottle 4. For example, the cold water tank 8 provides a separating plate 18, a cold water detector 20, etc. for its inside, provides a cover 22 and an evaporator 24 for its outside, and is connected to a cold water dispensing pipe 26.

The separating plate 18 is a means for separating the drinking water 6, which is stored in the cold water tank 8, into an upper layer and a lower layer. For example, a gap 30 is formed between an exterior tube 28 of the cold water tank 8 and the separating plate 18 as depicted in FIG. 2. The gap 30 is for letting the supplied drinking water flow to the lower layer of the cold water tank 8. Such separation by the separating plate 18 can limit convection of the cooled drinking water 6 to the upper layer of the cold water tank 8.

For example, an opening 32 and a recessed portion 34 are formed in the center portion of the separating plate 18. The opening 32 is formed like a pipe line extending to the bottom of the cold water tank 8, and connects to the water supply pipe 12. The opening 32 guides some of the supplied drinking water 6 to the water supply pipe 12 to supply the drinking water 6 to the hot water tank 10. The recessed portion 34 is an example of a means for forming a niche for the fallen separator float 14 as described below, and for receiving the drinking water 6, which drips down from the bottle 4 to be supplied to the cold water tank 8, and guiding the drinking water 6 to the opening 32.

The cold water detector 20 is an example of a water temperature detecting means for the drinking water 6 in the cold water tank 8. This cold water detector 20 monitors the situation where the drinking water 6 in the cold water tank 8 is cooling to a setting temperature in drinking water dispensing driving. In a purification process. for drinking water described below, the cold water detector 20 monitors the temperature of the drinking water 6, which circulates in the cold water tank 8, reaching a temperature set in a purification mode.

Figure 3:
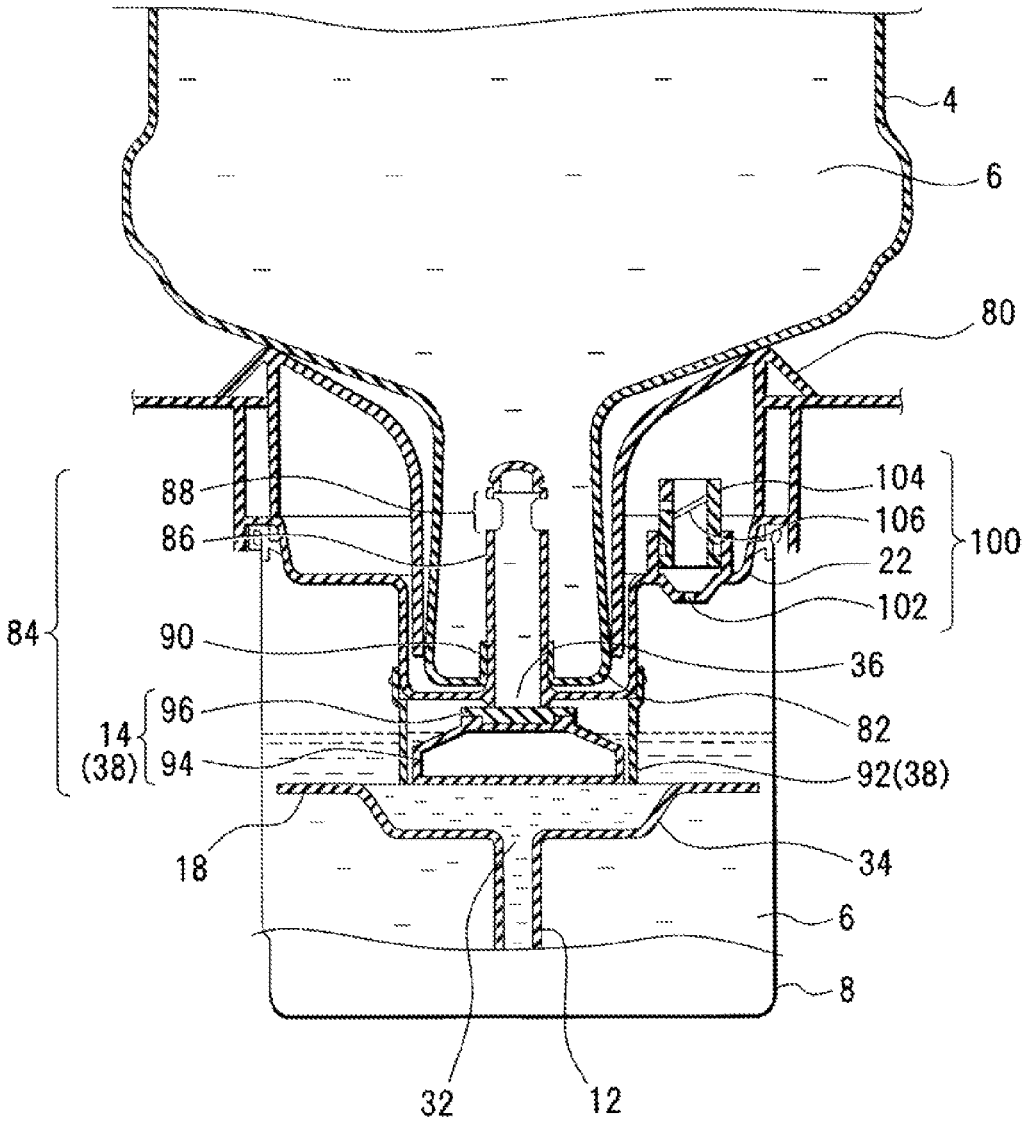
FIG. 3 depicts an example of a structure of a water supply portion of the drinking water dispenser.

The cover 22 is part of a housing of the drinking water dispenser 2. The cover 22 is placed in the upper side of the cold water tank 8, holds a valve 38 for opening and closing a water outlet 36 of the bottle 4, and provides an air intake 102 for taking in/out the air to/from the cold water tank 8 (FIG. 3).

The evaporator 24 is an example of a means for cooling the drinking water 6 in the cold water tank 8. For example, the evaporator 24 connects to a refrigerant pipe 40 for letting a refrigerant flow to the center or underneath of the outside of the cold water tank 8. This evaporator 24 provides cooling equipment 42 for the bottom of the drinking water dispenser 2. For example, this cooling equipment 42 consists of a compressor 44, a dryer 46 and a condenser 48. A capillary tube 50 is placed in the middle of the refrigerant pipe 40. The refrigerant pipe 40 passes between the cooling equipment 42 and the evaporator 24 to circulate a refrigerant. This circulation of a refrigerant cools the drinking water 6 in the cold water tank 8.

The cold water dispensing pipe 26 is a means for letting the drinking water 6, which is cooled in the cold water tank 8, flow to the cold water dispensing port 52. The cold water dispensing pipe 26 lets the drinking water 6 flow according to a water dispensing request by a user. For example, this cold water dispensing pipe 26 provides a cold water solenoid valve 54. The cold water solenoid valve 54 is a means for controlling dispensing the drinking water 6 and the flow rate of the drinking water 6 using the opening control thereof. For example, a user's press of a water dispensing button etc. causes the cold water solenoid valve 54 to open and close.

As much as the drinking water 6 dispensed from the cold water dispensing port 52 is supplied from the bottle 4 to the cold water tank 8.

The hot water tank 10 is an example of a means for heating and storing the supplied drinking water 6, and placed below the cold water tank 8. For example, this hot water tank 10 provides a hot water heater 56, a hot water dispensing pipe 58, etc. for its outside, and a hot water detector 60 for its inside. The hot water tank 10 also provides a drain pipe 62 for drainage.

The hot water heater 56 is an example of a means for heating the drinking water 6 in the hot water tank 10. For example, the hot water heater 56 heats the drinking water 6 in the hot water tank 10 to a setting temperature in the water dispensing driving. In the purification process described below, the drinking water 6 that flows from the cold water tank 8 to the hot water tank 10 is heated to a predetermined temperature.

The hot water dispensing pipe 58 is a means for letting the drinking water 6, which is heated in the hot water tank 10, flow to the hot water dispensing port 64. The hot water dispensing pipe 58 lets the drinking water 6 flow according to the water dispensing request by a user. For example, this hot water dispensing pipe 58 provides a hot water solenoid valve 66. The hot water solenoid valve 54 controls dispensing the drinking water 6 and the flow rate of the drinking water 6 using the opening control thereof. That is, a user's press of a water dispensing button etc. causes the hot water solenoid valve 66 to open and close, for example.

The water supply pipe 12 is an example of a pipe line that guides the drinking water 6 from the cold water tank 8 to the hot water tank 10. As described above, this water supply pipe 12 connects to the opening 32 that is provided for the separating plate 18 in the cold water tank 8, to be inserted into the ceiling of the hot water tank 10.

As much as the drinking water 6 dispensed from the hot water dispensing port 64 is supplied from the cold water tank 8 to the hot water tank 10. Simultaneously, the drinking water 6 is supplied from the bottle 4 to the cold water tank 8 since the supply of the drinking water 6 to the hot water tank 10 reduces the drinking water 6 in the cold water tank 8.

The hot water detector 60 is an example of a means for detecting the temperature of the drinking water 6 in the hot water tank 10. This hot water detector 60 monitors heating of the drinking water 6 in the hot water tank 10 at a setting temperature in the drinking water dispensing driving. In the purification process for the drinking water 6 described below, the hot water detector 60 monitors the temperature of the drinking water 6, which circulates in the hot water tank 10, reaching a temperature set in the purification mode.

Anything capable of monitoring the temperature of the drinking water 6 in the cold water tank 8 and the hot water tank 10 may be used as the cold water detector 20 and the hot water detector 60. For example, a thermistor thermometer may be used.

The drain pipe 62 is an example of a means for draining water etc. including the drinking water 6 in the drinking water dispenser 2. For example, the drain pipe 62 is placed in the bottom of the hot water tank 10. A drainage solenoid valve 68 is placed in the drain pipe 62, and a draining process is carried out according to draining instructions etc. The drain solenoid valve 69 may open and the draining process may be carried out also when there is no water dispensing request to the drinking water dispenser 2 for more than a predetermined time period or predetermined days, for example.

The separator float 14 is an example of the valve 38 for controlling the supply of the drinking water 6 from the bottle 4 to the cold water tank 8. The separator float 14 is floating on the drinking water 6 in the cold water tank 8. A rise and fall of the separator float 14 according to the water level in the cold water tank 8 causes the water outlet 36 for taking in the drinking water 6 to open and close.

The by-pass pipe 16 is an example of a pipe line that connects the cold water tank 8 and the hot water tank 10. The by-pass pipe 16 forms a circulation route for the heated drinking water 6 in the purification process for the drinking water 6 described below. For example, the by-pass pipe 16 provides a by-pass valve 70 to prevent the drinking water 6 from circulating in the cold water tank 8 and the hot water tank 10 in the water dispensing driving. For example, as depicted in FIG. 2, this by-pass pipe 16 may be positioned opposite to the cold water dispensing pipe 26 in the cold water tank 8 using the opening 32 of the separating plate 18 as the center.

It is better to position the by-pass pipe 16 apart from the opening 32 of the separating plate 18. For example, the opening 32 of the separating plate 18 is formed upper than the by-pass pipe 16, and the by-pass pipe 16 connects to the bottom of the cold water tank 8. This can prevent a short-cycle between the by-pass pipe 16 and the water supply pipe 12 in circulation of the drinking water 6 for purification.

This drinking water dispenser 2 further provides a control device 72 for controlling the water dispensing driving and the purification process.

Figure 4:
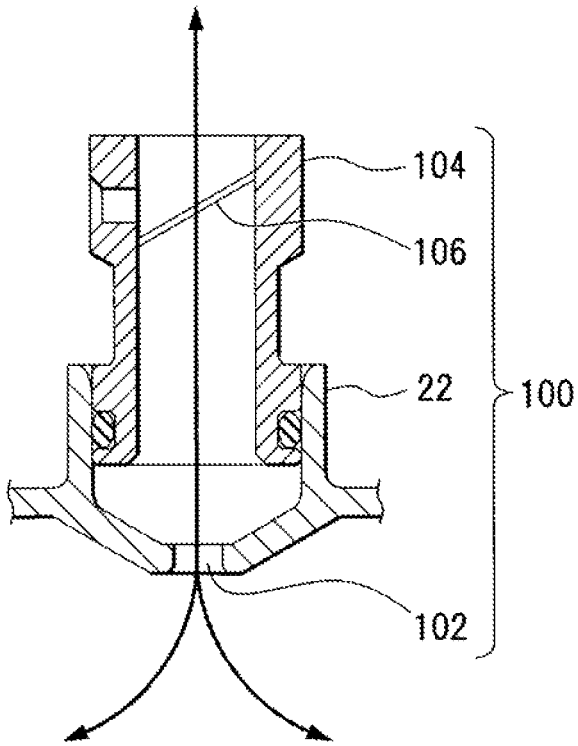
FIG. 4 depicts an example of a structure of an air intake unit.
Figure 5:
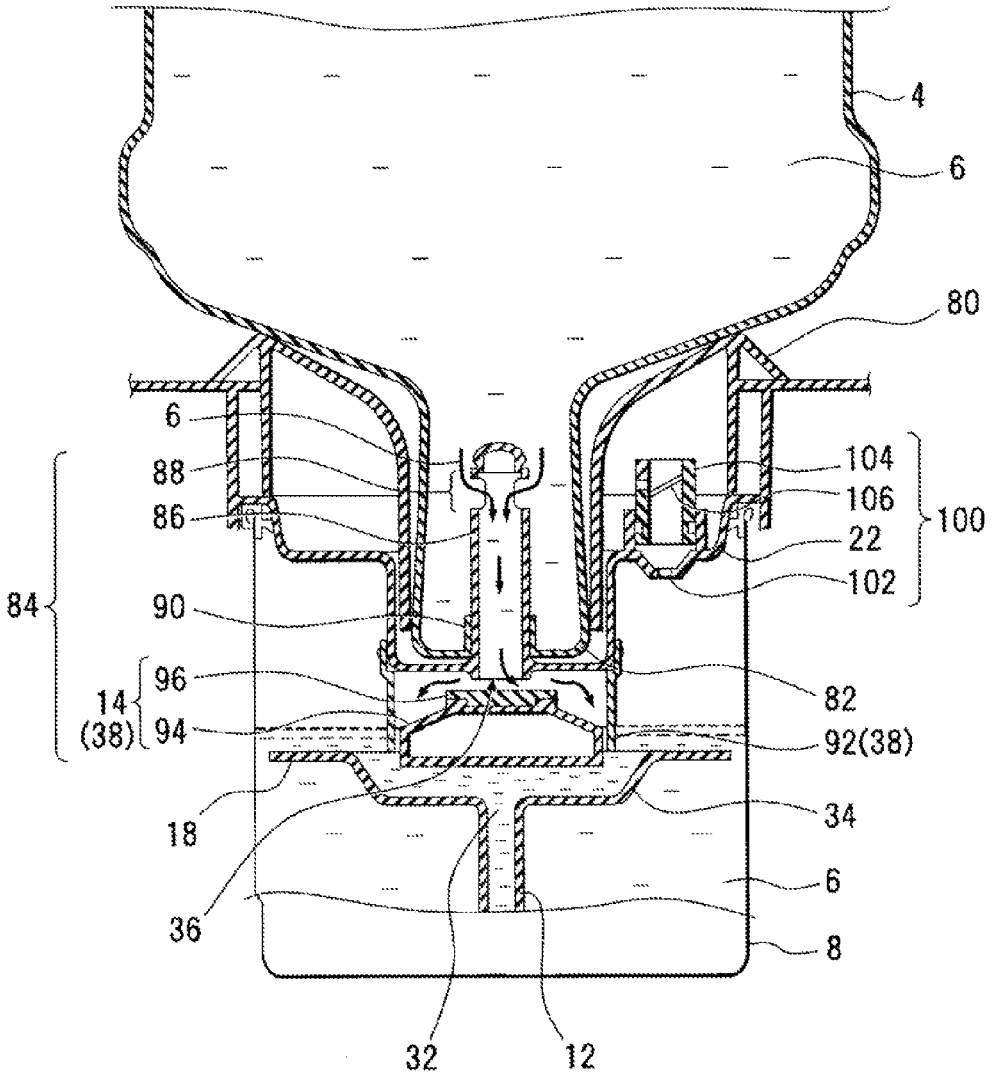
FIG. 5 depicts a supply state of drinking water from a bottle to the drinking water dispenser.
Figure 6:
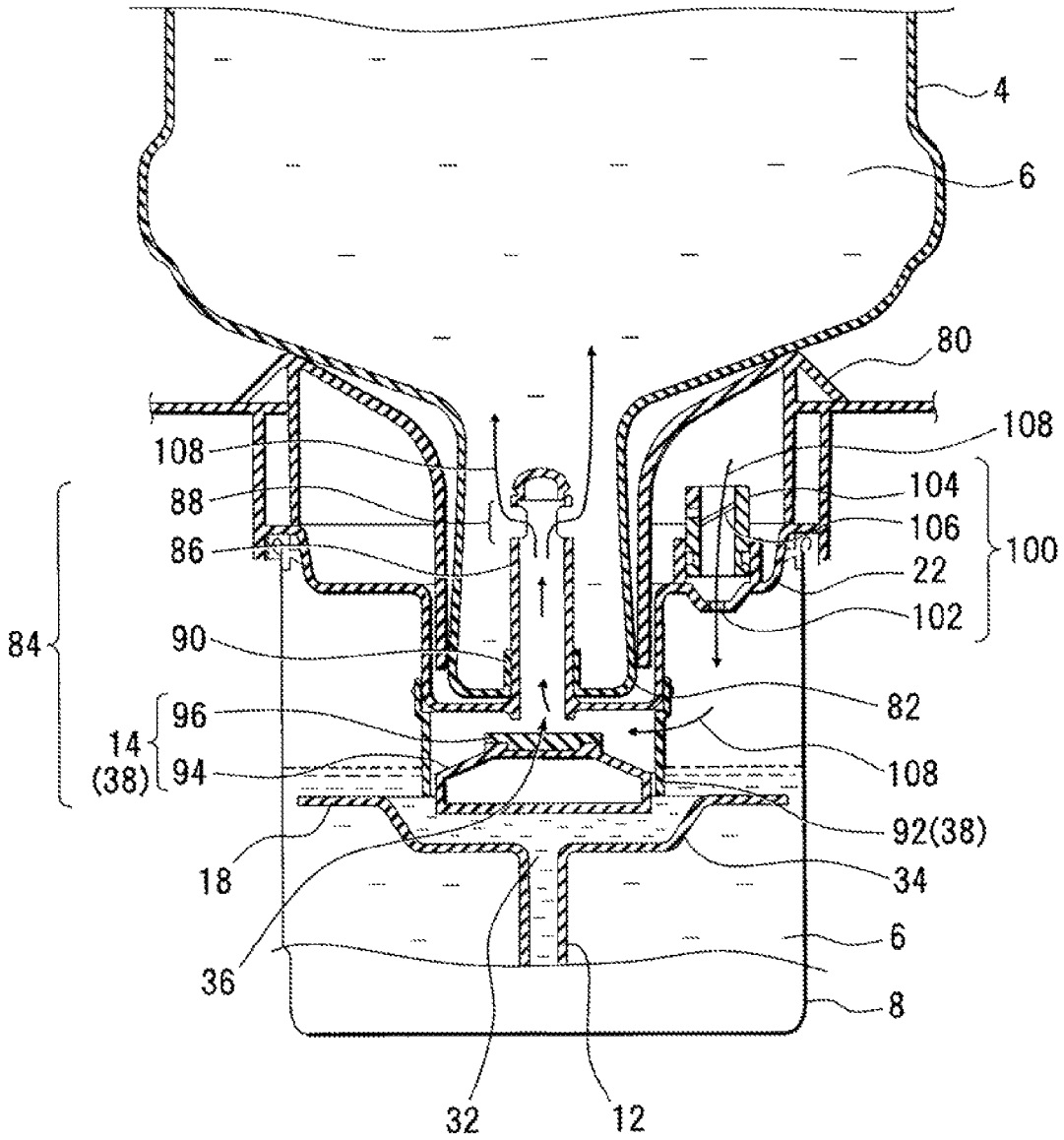
FIG. 6 depicts airflow under the supply state of drinking water from the bottle to the drinking water dispenser.
Figure 7:
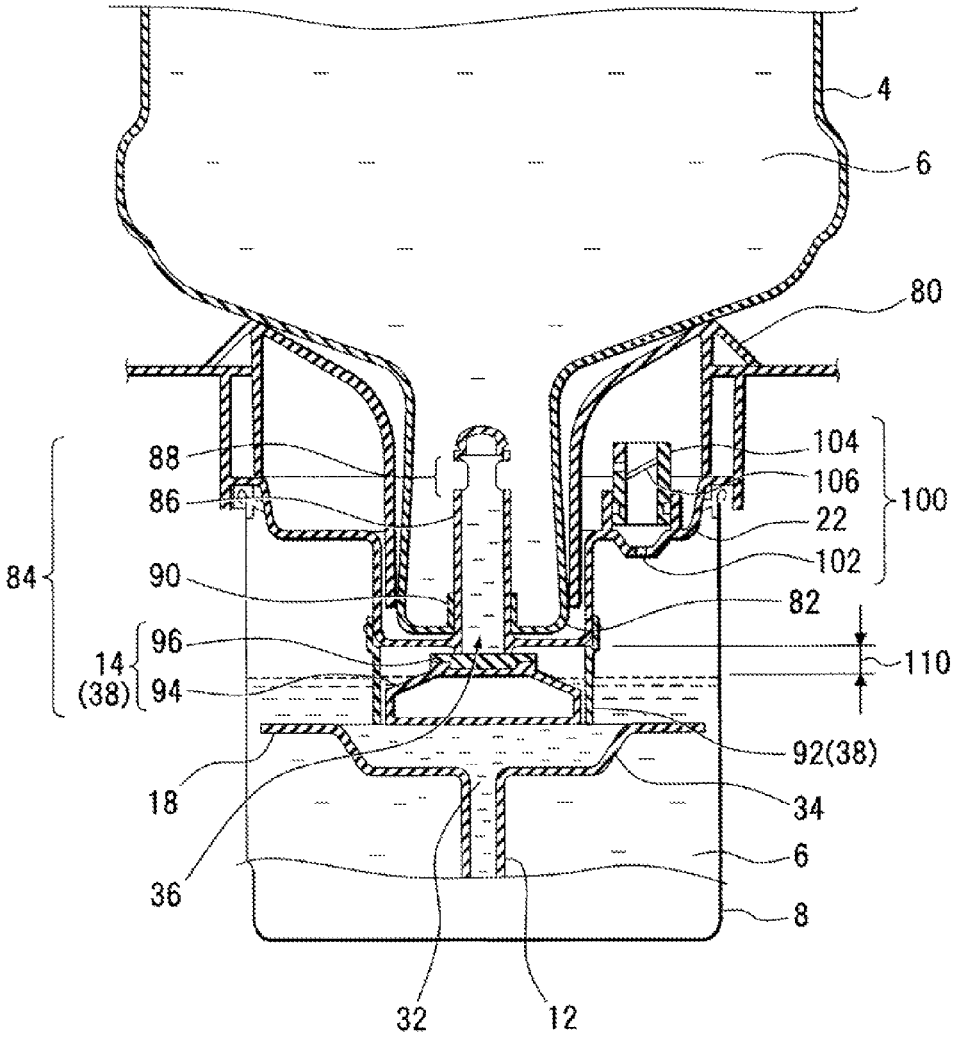
FIG. 7 depicts a shut state of a water outlet with a separator float.
Figure 8A:
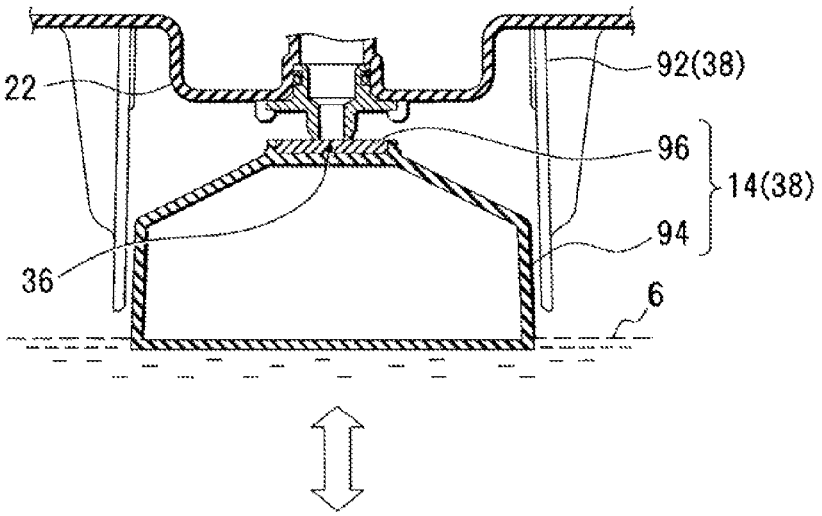
FIGS. 8A and 8B depict an example of open and close of the water outlet according to a rise and fall of the separator float.
Figure 8B:
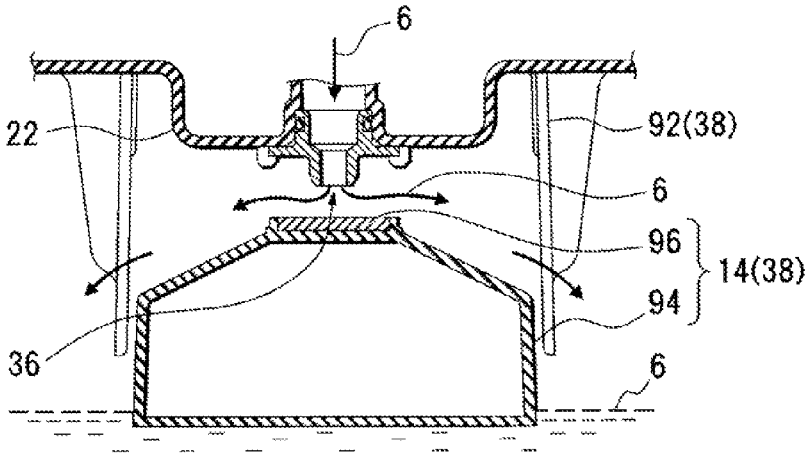

Principles of drinking water supply from the bottle to the cold water tank and a structure of the valve will be described with reference to FIGS. 3, 4, 5, 6, 7, 8A and 8B. FIG. 3 depicts an example of a structure of a water supply portion of the drinking water dispenser, FIG. 4 depicts an example of a structure of an air intake unit, FIG. 5 depicts a supply state of drinking water from the bottle to the drinking water dispenser, FIG. 6 depicts airflow under the supply state of drinking water from the bottle to the drinking water dispenser, FIG. 7 depicts a shut state of the water outlet with the separator float, and FIGS. 8A and 8B depict an example of open and close of the water outlet according to a rise and fall of the separator float. Each structure depicted in FIGS. 3, 4, 5, 6, 7, 8A and 8B is an example, and is not limited to this example.

The drinking water dispenser 2 provides a mount 80 for its ceiling. This mount 80 is a means for the bottle 4 to be mounted on, and for holding the bottle 4 so that a water supply port 82 of the bottle 4 is connected to a drinking water intake unit 84 of the drinking water dispenser 2.

The drinking water intake unit 84 provides a projection 86 that is formed from the cover 22, and the valve 38. This projection 86 is an example of a drinking water intake means, and is formed to be hollow. One end of the projection 86 has the water outlet 36 for pouring the drinking water 6 to the cold water tank 8, and a side of the other end of the projection 86 has an inlet 88 for taking in the drinking water 6 in the bottle 4.

The bottle 4 is placed on the mount 80, so that the projection 86 penetrates a water supply valve 90 in the water supply port 82 of the bottle 4 to be ready to supply the drinking water 6.

The valve 38 is a means for opening and closing the water outlet 36 to control an inflow of the drinking water 6, and, in the closed state, for preventing the drinking water 6 and its temperature from convecting between the bottle 4 and the cold water tank 8. For example, this valve 38 provides the separator float 14 that rises and falls according to the level of the drinking water 6 in the cold water tank 8, and a float cover 92 that connects to the cover 22.

The separator float 14 is a convection preventing means as well as an inflow control means for the drinking water 6 as described above. The separator float 14 provides a float part 94 in its lower side and a packing 96, which forms an open and close part of the water outlet 36, in its upper side. The float 94 is a means for letting the separator float 14 rise and fall according to the level of the drinking water 6 that is stored in the cold water tank 8. The packing 96 is an example of a means for cutting off the drinking water 6, which is supplied to the cold water tank 8, by touching the water outlet 36 due to a rise of the separator float 14. According to such a structure, the water outlet 36 is shut as the cold water tank 8 has a predetermined water level, and the supply of the drinking water 6 from the bottle 4 is stopped.

The float cover 92 is an example of a means for guiding the separator float 14 which rises and falls. For example, the float cover 92 has lattice. The drinking water 6 flows into the cold water tank 8 through the lattice.

The drinking water dispenser 2 further provides an air intake unit 100 for the cover 22, for example. This air intake unit 100 is an example of a means for taking in the air from the outside to the cold water tank 8. For example, the air intake unit 100 consists of the air intake 102 formed in the cover 22, a filter housing 104 and a filter 106 as depicted in FIG. 4. The filter housing 104 is made of tubular metal fittings, for example. The filter 106 is obliquely attached to the interior of the filter housing 104, close to the outside. Thereby, the filler 106 can be prevented from being clogged with condensation originating from expanding and moist air. A through hole may be provided for the bottom in order to discharge condensation to the outside.

This filter 106 is a means for preventing impurities etc. from being mixed in the cold water tank 8. For example, the filter 106 may be formed by an antibacterial material or anything having a bacterial filtration function, such as a polyethylene hollow fiber membrane having the pore size of 0.1 μm. The filter 106 may be formed by a membrane filter (polytetrafluoroethylene (PTFE) material: porous film filter) as well.

As depicted in FIG. 5, the water level in the cold water tank 8 falls, the separator float 14 falls, and then the supply of the drinking water 6 from the bottle 4 to the cold water tank 8 is started. The drinking water 6 in the bottle 4 goes into the projection 86 through the inlet 88, flows from the water outlet 36 toward the separator float 14, and is stored in the cold water tank 8.

For example, the drinking water 6 flowing into the cold water tank 8 flows toward the recessed portion 34 of the separating plate 18. Then, the drinking water 6 flows from the recessed portion 34 along the separating plate 18 through the gap 30 (FIG. 2) toward the lower layer of the cold water tank 8. The drinking water 6 stored in the recessed portion 34 of the separating plate 18 flows from the opening 32 through the water supply pipe 12 toward the hot water tank 10.

When the drinking water 6 is supplied, air 108 in the drinking water dispenser 2 passes through the float cover 92 from the air intake unit 100, and flows into the bottle 4 via the inside of the projection 86 as depicted in FIG. 6, for example. The air 108 flowing into the bottle 4 permits the drinking water 6 to be supplied from the bottle 4 to the cold water tank 8. That is, the drinking water 6 flowing out of the water outlet 36 causes a negative pressure inside the bottle 4. An outflow of the drinking water 6 is once stopped by an inflow of the air (breath) for the negative pressure, and the air 108 is taken into the bottle 4 from the air intake 102. When the negative pressure is relieved, the outflow of the drinking water 6 is stated. Such an outflow of the drinking water 6 and inflow of the air 108 are alternately repeated.

When the hot water tank 10 becomes full and the water level in the cold water tank 8 rises, the separator float 14 that is a convection suppressing means floats according to the water level in the cold water tank 8. As depicted in FIG. 7, the packing 96 touches the water outlet 36 to block the outflow of the drinking water 6 and suction (inflow) of the air. In this case, the packing 96 is positioned higher than the float part 94, and the level of the drinking water 6 is lower than the water outlet 36. Thus, an air layer 110 is formed between the water outlet 36 and the drinking water 6 under a water cut-off state. Thereby, the supply of the drinking water 6 is stopped, and thermal convection due to a temperature difference between the bottle 4 and the cold water tank 8 can be prevented.

The separator float 14 which rises and falls according to the water level in the cold water tank 8 functions as the valve 38 when the packing 96 adheres to the water outlet 36 as depicted in FIG. 8A. For example, the packing 96 which adheres to the water outlet 36 is formed by flexible silicone, and has as much hardness as the packing 96 can adhere with buoyancy of the separate float 14. For example, the bottom end of the water outlet 36 which adheres to this packing 96 may be flat.

For example, the separator float 14 is formed to be hollow in order that sufficient buoyancy is generated. This separator float 14 may be formed by a material which has water resistance, from which buoyancy is obtained, and which has enough weight against surface tension generated between the drinking water 6 and the packing 96. For example, the separator float 14 may be formed by resin or resin foam.

Consumption of the drinking water 6 in the cold water tank 8 or the hot water tank 10 causes the water level in the cold water tank 8 falls, and then, the separator float 14 also falls. When the packing 96 loses its retention brought by buoyancy, the packing 96 is released from the state of adhering to the water outlet 36 and the drinking water 6 flows from the bottle 4 into the cold water tank 8 (FIG. 8B).

Figure 9:
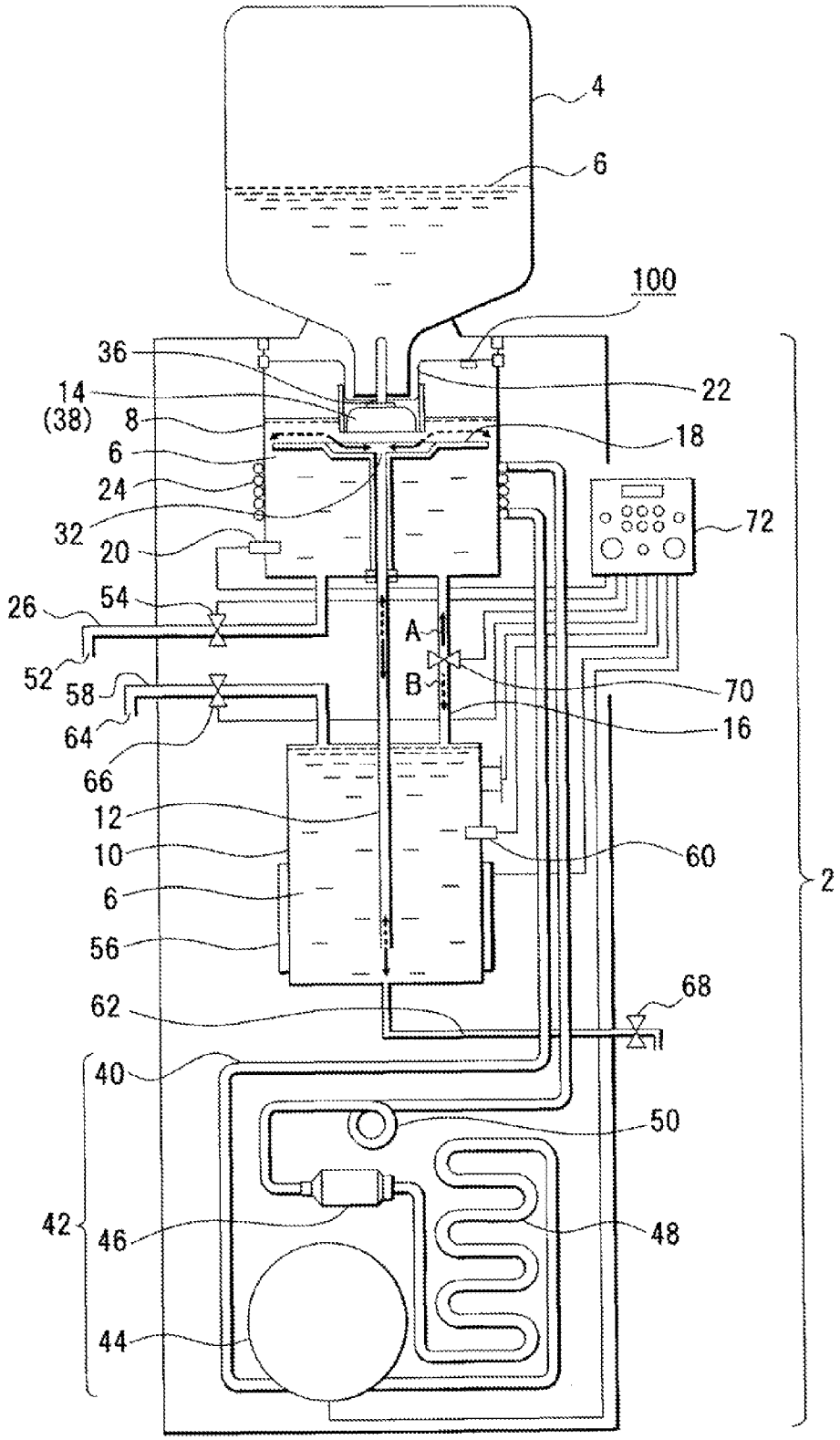
FIG. 9 depicts a flow of drinking water in the drinking water dispenser in a purification process.

The purification process of the drinking water 6 will be described with reference to FIG. 9. FIG. 9 depicts a flow of the drinking water in the drinking water dispenser in the purification process. A structure depicted in FIG. 9 is an example, and is not limited to this example. In FIG. 9, the same structure as that of FIG. 1 is denoted by the same reference numerals, and description thereof is omitted.

The purification of the drinking water 6 is to circulate the drinking water 6 in the cold water tank 8 and the hot water tank 10 to heat the drinking water 6 to a high temperature. For example, thermal convection is used for this circulation: this thermal convection is generated by the temperature difference between the drinking water 6 in the cold water tank 8 and the drinking water 6 in the hot water tank 10. This circulation causes the temperature of the drinking water 6 in the cold water tank 8 to rise to a temperature necessary for the purification.

In a circulation process of the drinking water 6, the by-pass valve 70 provided for the by-pass pipe 16 is opened, and a circulation loop is formed through the hot water tank 10, the by-pass pipe 16, the cold water tank 8 and the water supply pipe 12. In this circulation loop, the drinking water 6 of a high-temperature flows into the cold water tank 8 through the by-pass pipe 16, and the drinking water 6 of a low temperature in the cold water tank 8 flows into the hot water tank 10 through the water supply pipe 12, for example (an arrow A of a solid line in FIG. 9). As time elapses, the cold water tank 8 is filled with hot water from the hot water tank, the temperature thereinside becomes high, and the upper air in the cold water tank 8 expands. For example, this expanding air may be released via the air intake 102 to the outside.

During execution of this purification process, the separator float 14 that is a convection suppressing means continues to shut the water outlet 36, which prevents the drinking water 6 in the bottle 4 from being heated. When a purification operation is ended and the inside of the cold water tank 8 is cooled, an intake of released air causes the air layer 110 to be kept (FIG. 7), and the separator float 14 can keep water cut off.

In the purification process, the temperature of the drinking water 6 in the cold water tank 8 is monitored by the cold water detector 20. For example, this cold water detector 20 is positioned apart from the by-pass pipe 16 as depicted in FIG. 2. Thereby, an anomaly in circulation can be detected from measured time, a detected change in temperature, etc. even if a short-cycle occurs, that is, hot water circulates in only part of the cold water tank 8 to form layers of hot water and cold water, for example.

A direction of the circulation is not limited to the arrow A of a solid line in FIG. 9. There also may be a case that the drinking water 6 of a high-temperature flows from the water supply pipe 12 through the cold water tank 8 and the by-pass pipe 16 to the hot water tank 10 as depicted in an arrow B of a dotted line. At the same time, the drinking water 6 of a low-temperature flows into the hot water tank 10. According to such a case, the purification process of the drinking water 6 in the cold water tank 8 also can be carried out.

Figure 10:
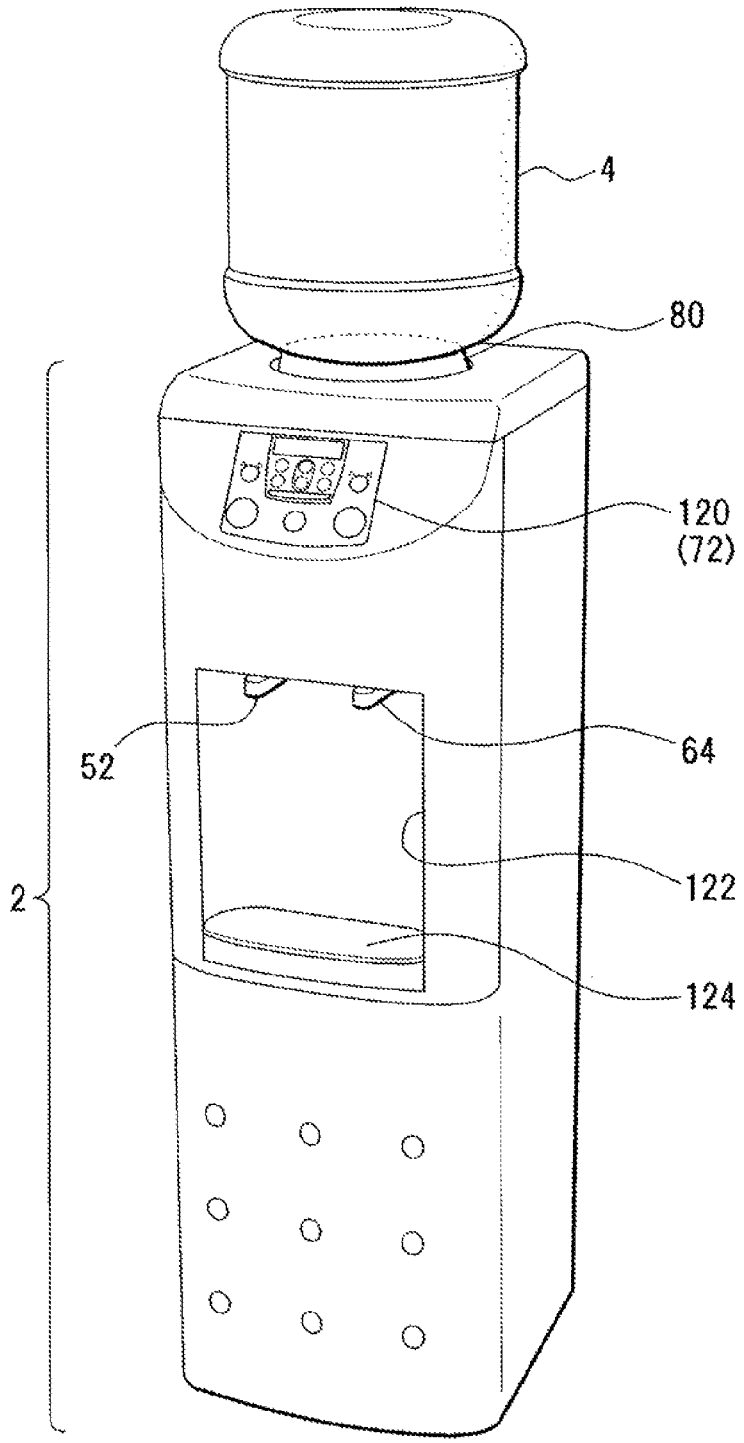
FIG. 10 depicts an example of an external structure of the drinking water dispenser.

An external structure of the drinking water dispenser will be described with reference to FIG. 10. FIG. 10 depicts an example of the external structure of the drinking water dispenser. The structure depicted in FIG. 10 is an example, and is not limited to this example.

For example, this drinking water dispenser 2 provides a display and operation part 120 for its upper front surface, and a water dispensing window 122 for its middle front surface. The display and operation part 120 provides a kind of a switch of instructing operation input etc. and a display of displaying a driving status etc., for example. The cold water dispensing port 52 and the hot water dispensing port 64 are installed inside the water dispensing window 122. A mount 124 is formed below these cold water dispensing port 52 and hot water dispensing port 64 in order for a cup etc. for receiving the dispensed drinking water 6 to be mounted on. For example, a drain means for the drinking water 6 may be provided for this mount 124.

Figure 11A:
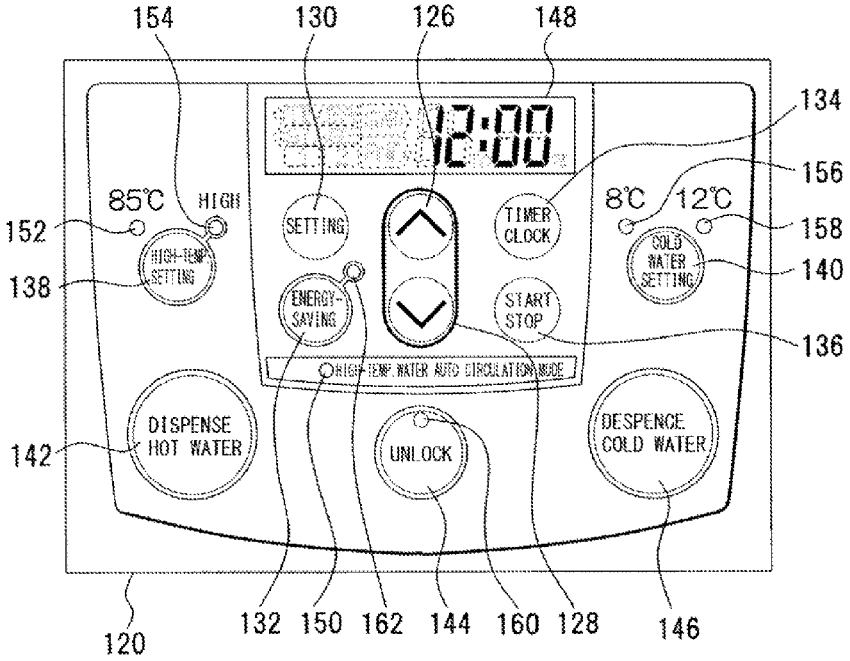
FIGS. 11A and 11B depict an example of a structure of a display and operation part of the drinking water dispenser.
Figure 11B:
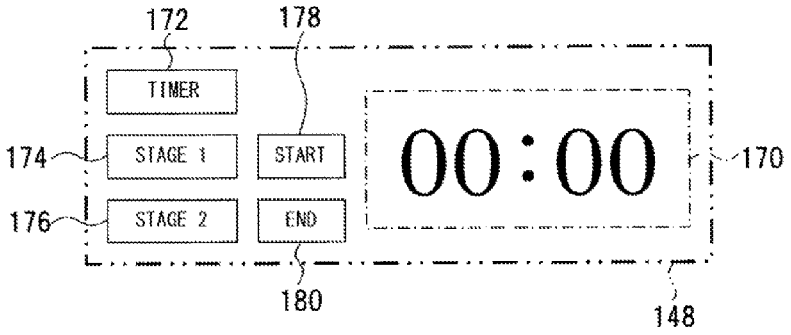
Figure 12:
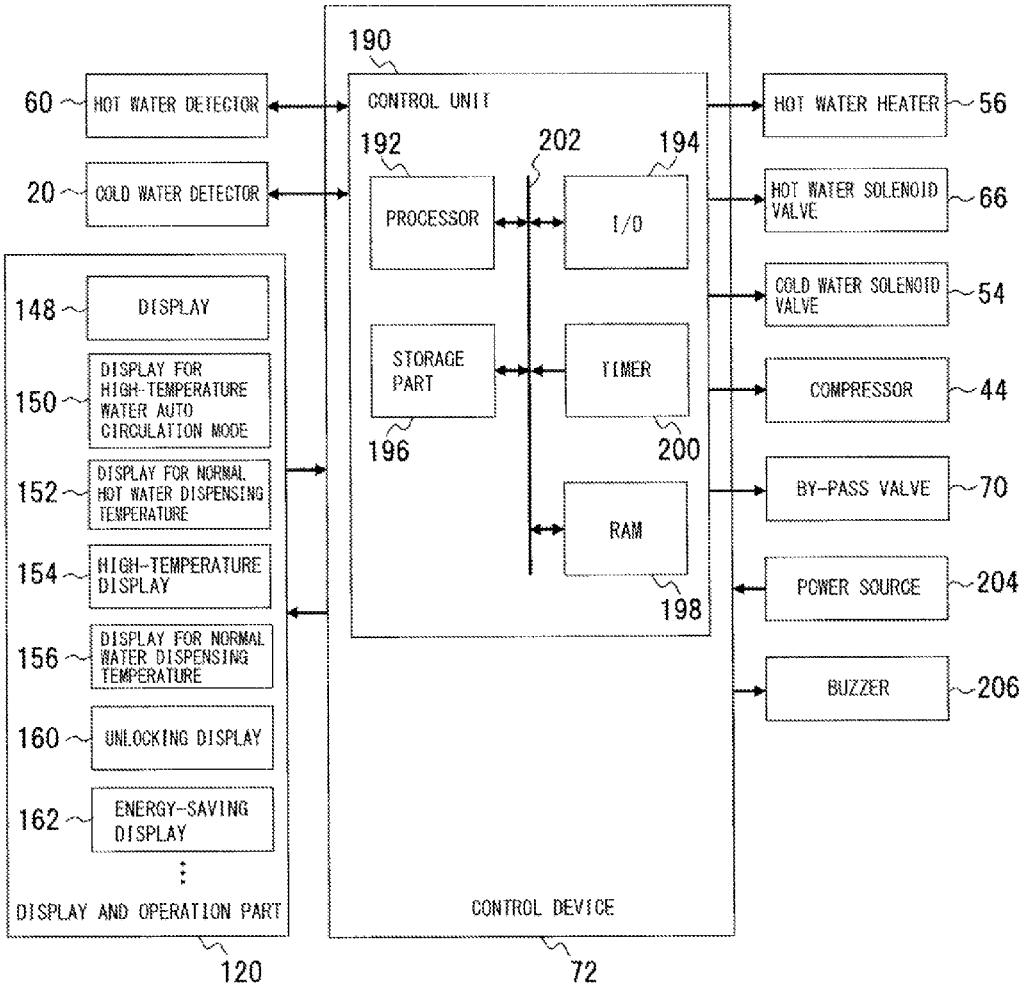
FIG. 12 depicts an example of a structure of a control unit.

Examples of structures of the display and operation part 120 and the control device 72, and an example of operation control of the drinking water dispenser 2 will be described with reference to FIGS. 11A, 11B and 12. FIGS. 11A and 11B depict an example of a structure of the display and operation part of the drinking water dispenser, and FIG. 12 depicts an example of a structure of the control device. Each of arrangement and processing contents depicted in FIGS. 11A, 11B and 12 is an example, and is not limited to this example.

The display and operation part 120 is an example of a means for operating setting instructions etc., and a means for displaying setting information, time information, etc. of the drinking water dispenser 2. For example, this display and operation part 120 provides an addition switch 126, a subtraction switch 128, a setting switch 130, an energy-saving switch 132, a timer and clock switch 134, a start and stop switch 136, etc. The display and operation part 120 also provides a high-temperature setting switch 138, a cold water setting switch 140, a hot water dispensing switch 142, an unlocking switch 144, a cold water dispensing switch 146, etc.

The addition switch 126 or the subtraction switch 128 is an example of a means for adding or subtracting a setting input value. The setting switch 130 is a means for input instructions of switching and cancelling a setting mode. The energy-saving switch 132 is a means for instructing operation of setting and cancelling an energy-saving mode, where in a preset time zone etc., heating and cooling temperatures of the drinking water 6 are limited, for example. The timer and clock switch 134 is a means for inputting a setting of a timer 200 (FIG. 12) and adjustment of time information. The start and stop switch 136 is a means for instructing start or stop of the timer 200, the setting of which has been inputted, and an operation mode. The high-temperature setting switch 138 is an example of a means for instructing a forcible change of water heating temperature, that is, a means for instructing a shift to a high-temperature setting different from normal driving (for example, 85° C.) or cancelling that instruction. The cold water setting switch 140 is an example of a means for instructing a forcible change of water dispensing temperature, that is, a means for instructing a shift to a cold water setting different from normal driving (for example, 8° C.) or cancelling that instruction. The hot water dispensing switch 142 is an instruction means for starting to dispense the heated drinking water 6 from the hot water dispensing port 64. The cold water dispensing switch 146 is an instruction means for dispensing water from the cold water dispensing port 52. The unlocking switch 144 is a means for permitting input operation to the hot water dispensing switch 142 and the cold water dispensing switch 146, which are locked.

For example, the display and operation part 120 also provides a display 148, a display for high-temperature water auto circulation mode 150, a display for normal hot water dispensing temperature 152, a high-temperature display 154, a display for normal water dispensing temperature 156, a mild temperature display 158, an unlocking display 160, an energy-saving display 162, etc.

The display 148 is an example of a means for displaying time etc. For example, a time display 170, a timer display 172, stage displays 174 and 176, a start display 178 and an end display 180 are set on the display 148 as depicted in FIG. 11B. For example, the time display 170 displays setting contents such as starting time of the purification process or the energy-saving mode in addition to normal clock display. The display for high-temperature water auto circulation mode 150 is a means for informing a user that the purification process using hot water circulation is being carried out. The display for normal hot water dispensing temperature 152 is an example of a means for indicating a setting of, for example, 85° C. as a normal water heating driving mode. The high-temperature display 154 is a means for displaying that water heating temperature is set high. The display for normal water dispensing temperature 156 is an example of a means for indicating a setting of, for example, 8° C. as a normal water dispensing mode. The mild temperature display 158 is a means for displaying that a water dispensing temperature is set mild, for example, in 12° C. The unlocking display 160 is a means for indicating whether the hot water dispensing switch 142 or the cold water dispensing switch 146 is unlocked by the unlocking switch 144. The energy-saving display 162 is a means for indicating that the energy-saving mode is running with a press of the energy-saving switch 132. These display means other than the display 148 consist of a lamp, for example, an LED (Light Emitting Diode). Liquid crystal display elements may be used for the display 148.

For example, the control device 72 of the drinking water dispenser 2 takes in information detected by the cold water detector 20, the hot water detector 60, etc., and performs various kinds of control such as cooling control, heating control, energy-saving control and the purification process. This control device 72 is composed of a control unit 190 that is made of a microcomputer and so on, and connected to the display and operation part 120 as depicted in FIG. 12. For example, in the control unit 190, a processor 192, an I/O (input/output) part 194, a storage part 196, a RAM (Random Access Memory) 198 and the timer 200 are connected to each other via a bus 202.

The processor 192 is composed of a CPU (Central Processing Unit) or an MPU (MicroProcessor Unit), and performs arithmetic processing of an OS (Operating System) and an operation program which are stored in the storage part 196. The I/O part 194 is an example of an interface for input and output of the control unit 190, and for example, takes in temperature information detected by the cold water detector 20 and the hot water detector 60. An operation control signal is also outputted through the I/O part 194 to the hot water heater 56, the hot water solenoid valve 66, the cold water solenoid valve 54, the compressor 44, the by-pass valve 70, etc. Further, operation instructions inputted from the display and operation part 120 are taken in, and a display control signal, etc is outputted also.

The storage part 196 is composed of a ROM (Read Only Memory). The storage part 196 is made up of a program storage part that stores an OS executed by the processor 192, an operation program of the drinking water dispenser 2, etc., and a data storage part that stores detected temperature information etc. The RAM 198 functions as a working area for processing the above operation program. The timer 200 is a time measuring means or a means for obtaining time information. For example, the timer 200 obtains time information on the operation control as well as carrying out a time measuring process as an interval timer described below.

A power source 204 that executes power feeding control of the drinking water dispenser 2, a buzzer 206 as an example of an informing means in case of an anomaly in operation, etc. may be connected to this control device 72.

An example of control by the control device 72 will be described below.

A) Default

When a power is turned on, the cooling equipment 42 for cooling the drinking water 6 is turned ON (for example, setting temperature: 8° C.) and the power feeding control over the hot water heater 56 for heating the drinking water 6 is turned OFF. In this case, operation for the unlocking switch 144 and the hot water dispensing switch 142 may be accepted in order to keep the availability of water heating. It is noted that when the power feeding control over the hot water heater 56 is under an OFF state, a temperature detected by the hot water detector 60 is a predetermined temperature, for example, 40° C. or below.

As to clock display of the display 148, an hour and a minute are displayed with blinking display of "--:--". A press of the addition switch 126, the subtraction switch 128 and the setting switch 130 determines time of the clock display.

The power feeding control over the hot water heater 56 is carried out when the start and stop switch 136 is pressed for a long time, for example, two seconds. A setting temperature during ON operation is set in 85° C., for example. A press for a long time, for example, two seconds in an ON state leads to the OFF state. If the hot water detector 60 uses a thermistor, the presence or not of the drinking water 6 can be determined using a self-heating characteristic of the thermistor to switch ON/OFF the power feeding control over the hot water heater 56.

As the power feeding control over the hot water heater 56 is shifted from the OFF state to the ON state, the energy-saving mode is into the OFF state. The same control is carried out when a power outage state is restored to a power feeding state. If time of the energy-saving mode is set, the time is stored in the storage part 196.

A time setting is carried out in a clock display mode. A time setting of the energy-saving mode is carried out in an energy-saving time setting mode.

B) Cold Water Dispensing Operation

When the cold water dispensing switch 146 is continuously pressed under a state of permitting the instructions thereof (unlocked), the cold water solenoid valve 54 is controlled into an opened state, and cold water is started to be dispensed. While the cold water dispensing switch 146 is pressed, this cold water solenoid valve 54 is controlled into the opened state and the operation of the hot water dispensing switch 142 is not accepted. That is, safety is secured because cold water and hot water are not concurrently dispensed.

C) Cold Water Switching Operation

If the cold water setting switch 140 is continuously pressed, a setting of a cold water temperature is changed. For example, the setting temperature is changed as follows: 8° C.->12° C.->8° C. . . . .

D) Unlocking Operation

If the unlocking switch 144 is pressed, the hot water dispensing switch 142 and the cold water dispensing switch 146 are unlocked, and the press thereof is permitted. In this time, the unlocking display 160 which is set on the unlocking switch 144 lights up in red and an unlocked state is displayed. Time limit is set for this unlocking. For example, if there has been no operation of the hot water dispensing switch 142 for 10 minutes, the unlocking display 160 is extinguished, and the unlocked state is switched to a locked state.

If the unlocking switch 144 is pressed again during unlocked, the unlocking display 160 is extinguished, and the unlocked state shifts to the locked state.

If dispensing hot water or cold water is ended and the press of the hot water dispensing switch 142 or the cold water dispensing switch 146 is stopped, the unlocking display 160 is extinguished after, for example, 10 seconds from this stop, and the unlocked state is into the locked state again.

E) Hot Water Dispensing Operation

If the hot water dispensing switch 142 is continuously pressed under its permitted state (unlocked), hot water solenoid valve 66 is into an opened state to dispense hot water. The hot water solenoid valve 66 is the opened state while the hot water dispensing switch 142 is pressed. While the hot water dispensing switch 142 is pressed, the operation of the cold water dispensing switch 146 is not accepted. That is, a process following a prior press of the hot water dispensing switch 142 or the cold water dispensing switch 146 is prioritized.

F) High-Temperature Setting Operation

The high-temperature setting switch 138 functions when the power feeding control over the hot water heater 56 is ON. The drinking water 6 in the hot water tank 10 is heated to a predetermined high-temperature, for example, 93° C. After this heating, predetermined hot water temperatures, for example, a range of 90° C. and the predetermined high-temperature is set as a proper temperature range of the high-temperature setting. After that, the setting temperature is switched to 85° C., for example. The high-temperature display 154 is lit in orange during the heating of the high-temperature setting. Informing by the buzzer 206 for a predetermined time, for example, ten seconds may be carried out as soon as the temperature of the high-temperature setting is reached. When the temperature of the high-temperature setting is reached, the high-temperature display 154 is lit in green and the power feeding to the hot water heater 56 is turned OFF. If hot water is within a high-temperature range (90° C. or over), the display of the high-temperature display 154 is continued.

When the high-temperature setting switch 138 is pressed during the high-temperature heating, the heating is suspended. After the heating, the power feeding to the hot water heater 56 is turned off. If the high-temperature setting switch 138 is pressed again, heating to the above described setting temperature, 93° C. is carried out. In this case, the high-temperature display 154 is lit in orange even if the temperature of hot water is within range of 90° C. and 92° C. If hot water is within the proper temperature range (85° C. and 89° C.) after the heating, the display for normal hot water dispensing temperature 152 is lit in green to display that the temperature is within the proper temperature range.

G) Energy-Saving Operation

If the power feeding control over the hot water heater 56 is OFF, the press of the energy-saving switch 132 is not accepted. When the energy-saving switch 132 is pressed under the ON state of the power feeding over the hot water heater 56, the energy-saving mode is started to run, and the energy-saving display 162 lights up in orange to display that the energy-saving mode is in the execution. If the energy-saving switch 132 is pressed in the energy-saving mode, the energy-saving mode is canceled and the energy-saving display 162 is extinguished.

When the energy-saving mode is in the execution and it is setting time of an energy-saving process, the energy-saving process is carried out and the energy-saving display 162 is lit in green.

H) Timer and Clock Operation

If the timer and clock switch 134 is pressed, the display 148 is changed from clock display to timer display to shift to a timer mode. If the timer and clock switch 134 is pressed in the timer mode, the display 148 shifts to the clock display. It is noted that when the timer 200 counts down, this counting may be continued.

I) Addition Operation, Subtraction Operation, Start and Stop Operation and Setting Operation If the addition switch 126 or the subtraction switch 128 is continuously pressed during a time setting mode or switching of the timer display, time or time periods for the timer is changed.

If the start and stop switch 136 is pressed during the timer display (stand-by), the timer 200 starts counting. If the start and stop switch 136 is pressed while the timer 200 is counting down, the counting down is suspended. A press of the start and stop switch 136 again restarts the counting down.

If the setting switch 130 is pressed, determination in the time setting is carried out, and the energy saving mode is started. The press of the setting switch 130 after start of a process in the execution ends this process to enable a setting to be switched.

J) Clock Display

When the power source 204 is turned ON, the clock display is generated. A continuous press of the timer and clock switch 134 leads to the time setting mode. In this setting mode, the clock display is blinking. The display is changed by a press of the addition switch 126 or the subtraction switch 128, and a press of the setting switch 130 or a lapse of a predetermined time determines the setting. For example, a press of the addition switch 126 changes the time display in the time setting mode as follows: 12:01->12:02->12:03 . . . . A continuous press thereof changes the display as follows, for example: 12:10->12:20->12:30 . . . 13:00->13:30->14:00 . . . 15:00->16:00. As well, a press of the subtraction switch 128 changes the display as follows, for example: 11:59->11:58->11:57 . . . , and a continuous press thereof changes the display as follows, for example: 11:50->11:40->11:30 . . . 11:00->10:30->10:00 . . . 9:00->8:00.

K) Timer Function

If the timer and clock switch 134 is pressed, "m" and "s" are displayed on the display 148, for example, and the display 148 becomes the timer display. In this case, for example, 300 is displayed in default. The maximum time period of the timer is 60 minutes, for example. Minute display is changed by a press of the addition switch 126 or the subtraction switch 128 during the timer display (stand-by). A press of the addition switch 126 changes the display as follows: 3->3.30->4->4.30->5 . . . 10->11. The display continuously changes up to the maximum, 60 minutes. A press of the subtraction switch 128 changes the display as follows: 3->2.30->2->1.30->1->0.30->00. A press of the start and stop switch 136 starts the timer 200 counting down. A minute setting can be changed if the addition switch 126 or the subtraction switch 128 is pressed during the counting down. When the timer 200 becomes 0:00, the buzzer 206 is actuated and a user is informed.

L) Energy-Saving Time Setting

Two stages of settings can be carried out as to energy-saving time, for example. A method for setting the energy-saving time is the same as the time setting. If the settings of these stages are carried out, the energy-saving mode is executed when conditions of a setting are met. An example of the setting for the energy-saving mode will be depicted as follows.

(1) If the power feeding control over the hot water heater 56 is ON under a clock display state, the stage display 174, which represents a first stage, and the start display 178 are displayed on the display 148 when the energy-saving switch 132 is pressed. For example, time display "--:--" is displayed at the first time when a setting has not been carried out. Current time or the time that was set last time may be displayed on a setting screen at the second time and later.

When time is set and the setting switch 130 is pressed, the stage display 176, which represents a second stage, and the start display 178 are displayed on the display 148 instead of the display of the stage display 174 and the end display 180. As well, when time is set, the stage display 176 and the end display 180 are displayed.

(2) Time can be set by pressing the addition switch 126 or the subtraction switch 128. This setting operation is the same as the time setting.

(3) A press of the setting switch 130 determines setting contents. The clock display is displayed again after 10 seconds have elapsed since no switch operation is executed during each operation or since operation is ended. If a setting is desired to be canceled, a stage desired to be canceled is selected by the setting switch 130, and either the addition switch 126 or the subtraction switch 128 is pressed, or both of them are pressed simultaneously. Thereby, "--:--" is displayed on the display 148. A press of the setting switch 130 can determine the setting contents.

Figure 13:
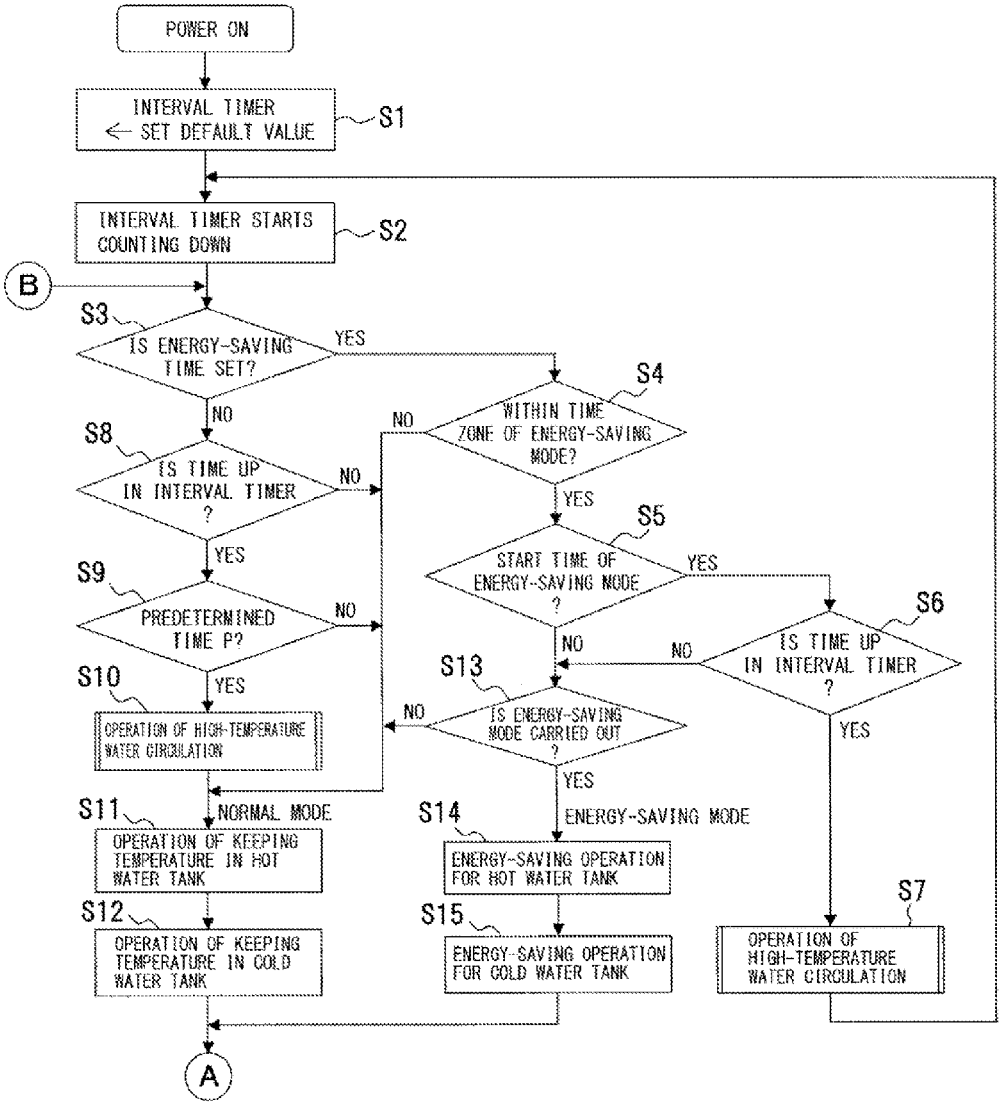
FIG. 13 is a flowchart depicting an example of driving control of the drinking water dispenser.
Figure 14:
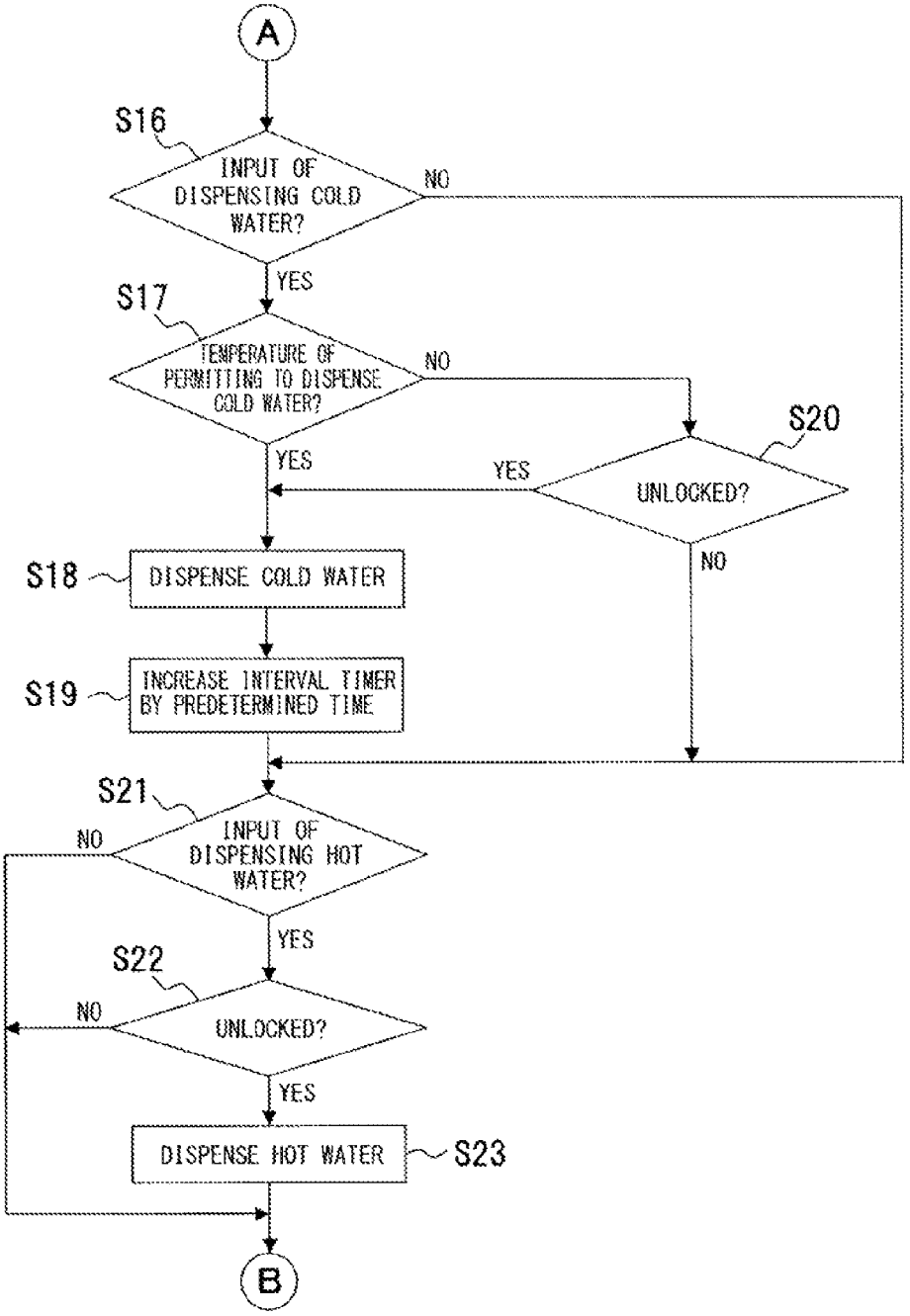
FIG. 14 is the flowchart depicting an example of the driving control of the drinking water dispenser.

Driving control of the drinking water dispenser 2 will be described with reference to FIGS. 13 and 14. FIGS. 13 and 14 is a flowchart depicting an example of the driving control of the drinking water dispenser. Processing contents, procedure, etc. depicted in FIGS. 13 and 14 are example. A and B in FIGS. 13 and 14 depict connectors between the flowcharts.

This process is an example of a control method of the drinking water dispenser, and depicts an example of control of dispensing hot or cold water, and of control of the purification process of the drinking water dispenser 2. In this process, control is executed using elapsed time and time information, for example. This process is repeatedly executed while the drinking water dispenser 2 is powered on.

After the drinking water dispenser 2 is powered on, a default value, for example, 72 (hours) is set for a timer for counting the interval of executing the purification process (step S1) other than the initial setting for every part, and counting down is started (step S2).

After the start of counting, whether the start time of the energy-saving mode is set is checked (step S3). If the time is set (YES of step S3), current time information is obtained from the timer 200, another clock function, or a clock function outside, for example. In this step S3, to execute the purification process with high-temperature water circulation when the energy-saving mode is executed is determined as one timing of executing the purification process. That is, for example, energy-saving is aimed in the energy-saving mode where a thermal keeping setting temperature of cold and hot water is changed in a time zone when a user does not use, or seldom uses the drinking water dispenser 2, such as a midnight time zone. The drinking water 6 can not be dispensed during the process of the high-temperature water circulation. Thus, dispensing the drinking water 6 to a user is not interrupted, and the convenience can be increased if the process of the high-temperature water circulation is carried out at the timing of this energy-saving mode.

It is determined whether the current time is within a time zone of the energy-saving mode or not with reference to the obtained time information (step S4). If the current time is within a time zone of the energy-saving mode (YES of step S4), whether to execute the process of the high-temperature water circulation is determined with reference to the start time of the energy-saving mode (step S5). That is, the purification with the high-temperature water circulation is carried out at the timing of switching to the energy saving-mode. This is because the setting temperature in a normal mode has less difference than the setting temperature in the energy-saving mode from the setting temperature of the process of the high-temperature water circulation when the drinking water 6 is heated. That is, the temperature of the drinking water 6 in the hot water tank 10 after a shift to the energy-saving mode is lower than that in the normal mode, and in that case, further heating that is capable of raise the temperature of the drinking water 6 in the energy-saving mode to that in the normal mode would be necessary to be carried out. Thus, the purification process is carried out at the start timing of the energy-saving mode. The purification process with the high-temperature water circulation needs a certain time. So, whether to execute the process of the high-temperature water circulation is determined with reference to time of starting the energy-saving mode in order to prevent the energy-saving mode from ending during the process of high-temperature water circulation.

In the case of the start time of the energy-saving mode (YES of step S5), whether time is up in the interval timer is determined (step S6). For example, whether the default value set in step S1 has elapsed is determined with reference to the timer 200. If the time is up in the interval timer (YES of step S6), the process of the high-temperature water circulation is carried out (step S7), and the procedure returns to step S2.

If the energy-saving time is not set (NO of step S3), whether the time is up in the interval timer is determined (step S8). This step S8 represents executing the purification process with the high-temperature water circulation during normal driving as one timing of executing the purification process.

If time is up in the interval timer (YES of step S8), it is determined whether the current time is a predetermine time P that is set in advance, for example, 2 a.m. (step S9). This process of the high-temperature water circulation is set so as to be carried out at the predetermined time P after a default value, for example, 3 days (72 hours) elapses. In a case of the predetermined time P (2 a.m.) after time is up in the interval timer (YES of step S9), the process of the high-temperature water circulation is carried out (step S10).

After the end of the process of the high-temperature water circulation, the drinking water 6 in the hot water tank 10 is kept the setting temperature (step S11) and the drinking water 6 in the cold water tank 8 is kept the setting temperature (step S12) as the normal mode.

If time is not up in the interval timer (NO of step S8) or if it is not the predetermined time P even if time is up in the interval timer (NO of step S9), the procedure shifts to step S11 as the normal mode.

If the start time of the energy-saving mode is set (YES of step S3) but it is not within a time zone of the energy-saving mode (NO of step S4), or if the energy-saving mode is not carried out (NO of step S13), the procedure also shifts to step S11 for shifting to the normal mode.

If the energy-saving time is set (YES of step S3) but the procedure does not shift to operation of the high-temperature water circulation, the energy-saving switch 132 is pressed to determine whether an input of executing the energy-saving mode has been carried out (step S13), and the procedure shifts to the energy-saving mode. Examples of a case where the procedure does not shift to the operation of the high-temperature water circulation is a case where time is not up in the interval timer (NO of step S6) and a case of not the start time of the energy-saving mode (NO of step S5). In this energy-saving mode, the drinking water 6 in the hot water tank 10 is managed under the setting temperature of the energy-saving mode (step S14) and the drinking water 6 in the cold water tank 8 is managed under the setting temperature of the energy-saving mode (step S15).

In temperature management of the normal mode, the temperature of the drinking water 6 in the hot water tank 10 is detected by the hot water detector 60, and operation control of the hot water heater 42 is executed so that the temperature becomes the setting temperature, or the temperature of the drinking water 6 in the cold water tank 8 is detected by the cold water detector 20, and operation control of the evaporator 24 is executed so that the temperature becomes the setting temperature. In the energy-saving mode, the temperature of the drinking water 6 in the hot water tank 10 is managed lower than that of the normal mode, and the temperature of the drinking water 6 in the cold water tank 8 is managed higher than that of the normal mode.

In the control of dispensing cold water or hot water, as depicted in FIG. 14, whether the input of dispensing cold water has been executed is determined in both driving states of the normal mode and the energy-saving mode (step S16). This is determined based on detection whether the cold water dispensing switch 146 has been pressed, for example. If the input of dispensing cold water has been executed (YES of step S16), the procedure shifts to determination whether to be a temperature of permitting to dispense cold water (step S17). This temperature of permitting to dispense cold water is a temperature that is set for preventing the drinking water 6 of high-temperature from flowing out of the cold water dispensing port 52 in a case of the water dispensing request just after the operation of the high-temperature water circulation, for example. Therefore, water cannot be dispensed when the cold water detector 20 detects to be the predetermined temperature, that is set in advance, or over.

If the drinking water 6 in the cold water tank 8 is the temperature of permitting to dispense cold water (YES of step S17), the cold water solenoid valve 54 is opened and water is dispensed (step S18). At this time, counting time of the interval timer is increased by a predetermined time Tx (step S19). As to this increase by the predetermined time Tx, an interval time may be increased according to frequency of water dispensing requests and the dispensing volume of the drinking water 6, for example. That is, the purification of the drinking water 6 in the cold water tank 8 is executed for preventing the quality of water from changing when the drinking water 6 of low-temperature stays still without being used for long time. If water is dispensed, the interval time of the purification process is increased because the drinking water 6 does not stay still in the cold water tank 8.

If it is not the temperature of permitting to dispense cold water (NO of step S17) but the unlocking switch 144 is pressed (YES of step S20) by the operation of a user, for example, water may be dispensed.

If the input of dispensing cold water is not carried out (NO of step S16), or if it is not the temperature of permitting to dispense cold water (NO of step S17) and unlocking is not performed (NO of step S20), the procedure shifts to determination whether an input of dispensing hot water is carried out (step S21). This is determined by whether the hot water dispensing switch 142 has been pressed by a user, for example.

In a hot water dispensing process, whether to be unlocked or not (step S22) is determined, hot water is dispensed (step S23), and the procedure returns to step S3. If the input of dispensing hot water is not carried out (NO of step S21) or unlocking is not performed (NO of step S22), the procedure also returns to step S3.

The above described default value of the interval timer, the start time of the energy-saving, and the start time of the process of high-temperature water circulation except the energy-saving time are examples set in the drinking water dispenser 2 in advance. They may be set or changed by a user optionally.

Figure 15:
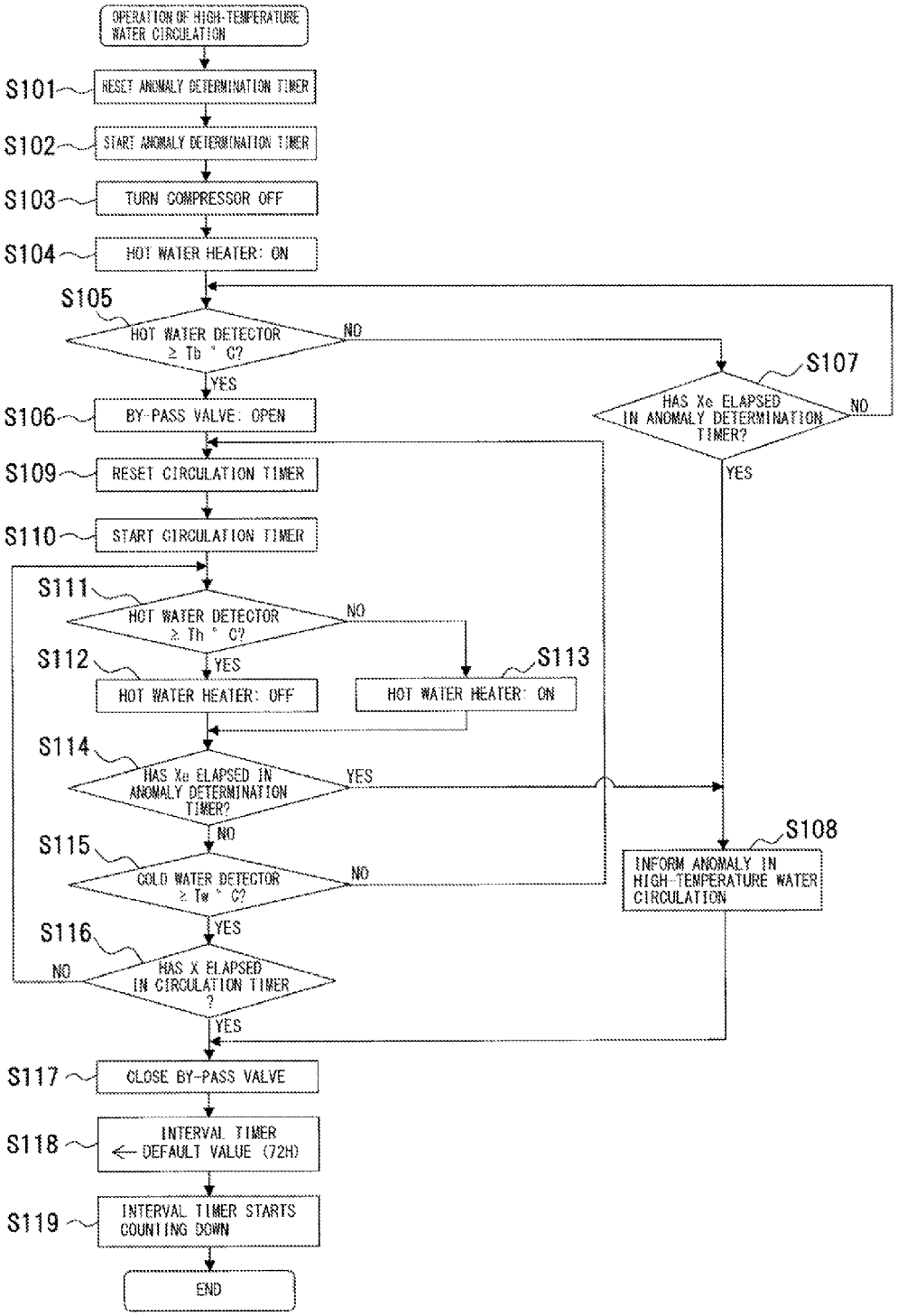
FIG. 15 is a flowchart depicting a process of high-temperature water circulation operation.

The purification process of the drinking water 6 with the high-temperature water circulation will be described with reference to FIG. 15. FIG. 15 is a flowchart depicting procedure of the purification with the high-temperature water circulation, which is a subroutine.

In this purification process with the high-temperature water circulation, the drinking water 6 that is heated to a purification temperature Tw, for example, 85° C. or over is circulated in the cold water tank 8. Then the circulation process of high-temperature water is carried out for a purification time period X, for example, 30 minutes (step S115 to step S116). This purification process also includes a heating process for keeping the temperature of the circulating drinking water 6 the purification temperature Tw (step S111 to step S113), and an anomaly determination process in the purification process and an informing process of an anomaly (step S101 to step S102, step S114 and step S107 to step S108).

At the start of the operation of the high-temperature water circulation, the timer 200 as an anomaly determination timer for monitoring an anomaly of the purification is reset (step S101) to be started (step S102). In order to raise the temperature of the drinking water 6 in the cold water tank 8, the compressor 44 that is a cooling means is stopped (step S103) and the hot water heater 56 is operated (step S104).

After the start of heating the drinking water 6 by the hot water heater 56, it is determined whether the temperature of the drinking water 6 in the hot water tank 10 is a circulation start temperature Tb, for example, 90° C. or over (step S105). The circulation start temperature Tb is a preparatory high temperature for generating thermal convection using the difference in temperature. For example, the circulation start temperature Tb may be monitored by the hot water detector 60. It is checked whether the hot water heater 56 functions as a heating means for the process of the high-temperature water circulation by this monitoring of the circulation start temperature Tb.

If the temperature of the drinking water 6 in the hot water tank 10 is the temperature Tb or over (YES of step S105), the by-pass valve 70 is opened (step S106), a circulation loop is formed between the cold water tank 8 and the hot water tank 10, and the circulation of the heated drinking water 6 is started.

If the temperature of the drinking water 6 is below the temperature Tb (NO of step S105), it is determined whether anomaly monitoring time Xe of a predetermined time, for example, two hours has elapsed (step S107) with reference to the timer 200, which is the anomaly determination timer. A longer time than time necessary for the purification process is set for this anomaly monitoring time Xe, for example. If the time Xe has not elapsed (NO of step S107) based on this determination, the procedure returns to step S105, and the monitoring is continued. If the time Xe has elapsed (YES of step S107), it is determined that there is some anomaly in the hot water heater 56, for example, to carry out informing of an anomaly in the high-temperature water circulation (step S108).

After the by-pass valve 70 is shifted to be an opened state (step S106) to start the circulation, the timer 200 as a circulation timer for measuring the purification time X is reset (step S109), and then started (step S110). In this case, the timer 200, different from the above described anomaly determination timer, measures circulation time.

During the circulation of the drinking water 6, it is monitored that the temperature of the drinking water 6 in the hot water tank 10 is a predetermined temperature Th, for example, 93° C. or over (step S111). That is, in order to continue the circulation of the drinking water 6 with thermal convection, it is monitored by the hot water detector 60 that the drinking water 6 of high-temperature in the hot water tank 10 is the predetermined temperature Th or over. If the drinking water 6 is the predetermined temperature Th or over (YES of step S111), the hot water heater 56 is stopped (step S112). If the predetermined temperature Th is not reached (NO of step S111), the heating with the hot water heater 56 is kept (step S113).

It is determined whether the above described time Xe has elapsed since the start of the operation of the high-temperature water circulation (step S114) with reference to the timer 200 as monitoring the anomaly determination timer. If the time Xe has not elapsed (NO of step S114), the procedure shifts to monitoring of the temperature of the drinking water 6 in the cold water tank 8. If the time Xe has elapsed (YES of step S114), it is determined that some anomaly occurs in the circulation process, and the above described informing of an anomaly in the high-temperature water circulation is carried out (step S108). That is, if the purification process cannot be completed even if the anomaly monitoring time Xe has elapsed, it is determined to be an anomaly in the high-temperature water circulation. For example, this anomaly in the circulation is generated when there is some anomaly in the by-pass pipe 16 or the by-pass valve 70, or when the heated drinking water 6 is circulated around the cold water tank 8 in a short cycle.

In the monitoring of the temperature of the drinking water 6 in the cold water tank 8, it is determined whether the temperature of the drinking water 6 is the purification temperature Tw or over (step S115). This monitoring of the temperature is carried out by the cold water detector 20. If the drinking water 6 is not the purification temperature Tw or over (NO of step S115), the procedure returns to step S109, and the heating process is continued. In a case of the purification temperature Tw or over (YES of step S115), the procedure shifts to determination whether the purification time X has elapsed since the start of measuring the circulation timer (step S110) (step S116).

The monitoring of the temperature of the drinking water 6 in the cold water tank 8 is repeated until the purification time X has elapsed under the temperature of the purification temperature Tw or over (NO of step S116). If the purification time X has elapsed (YES of step S116) or informing of an anomaly in the high-temperature water circulation (step S108) is carried out, the procedure shifts to an ending process of the purification process with the high-temperature water circulation. The by-pass valve 70 provided for the by-pass pipe 16 is closed (step S117), the default value is set for the interval timer (step S118), counting down is started (step S119), and the operation of the high-temperature water circulation is ended.

According to such a structure, the drinking water 6 in the cold water tank 8, and the drinking water 6 of high-temperature in the purification or its heat cannot be converted to the bottle. Thereby, a temperature change is not generated in the drinking water 6 stored in the bottle 4. Also, it causes the purification function not to deteriorate that the temperature of the circulating drinking water 6 is prevented from falling resulting from the convection between the heated drinking water 6 and the drinking water 6 in the bottle 4. Also, the drinking water 6 can be prevented from leaking resulting from erroneous operation at the water outlet 36 due to expansion or compression of the air in the bottle 4 because the heat of the heated drinking water 6 is not transmitted to the bottle 4.

Second Embodiment

A second embodiment is an example of a variation of the valve 38 for controlling the supply of the drinking water 6 from the bottle 4 to the cold water tank 8. This embodiment depicts a case of using a ball tap system.

Figure 16:
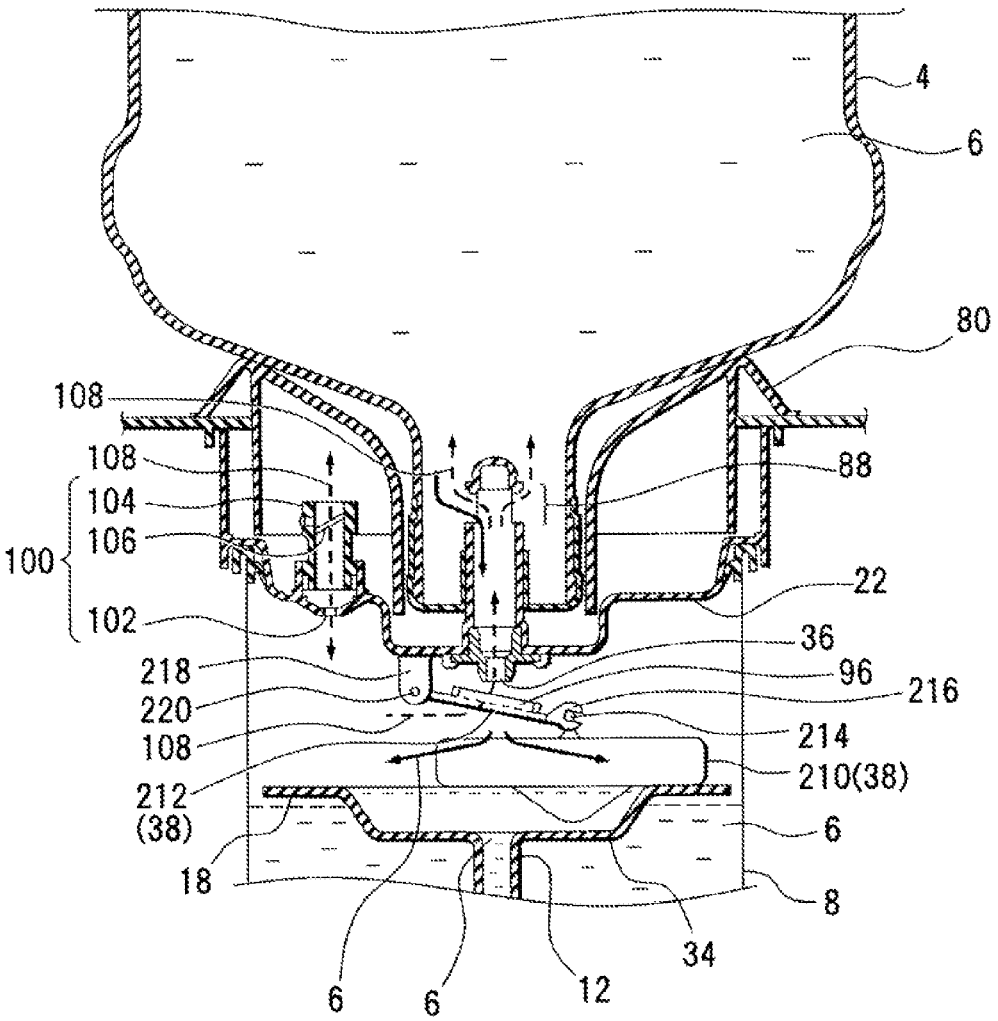
FIG. 16 depicts an example of a structure of a valve according to a second embodiment.
Figure 17A:
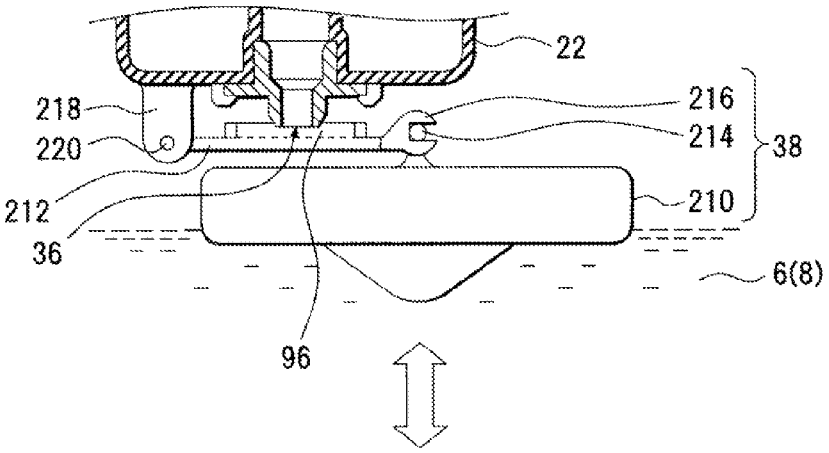
FIGS. 17A and 17B depict opened and closed states of the valve.
Figure 17B:
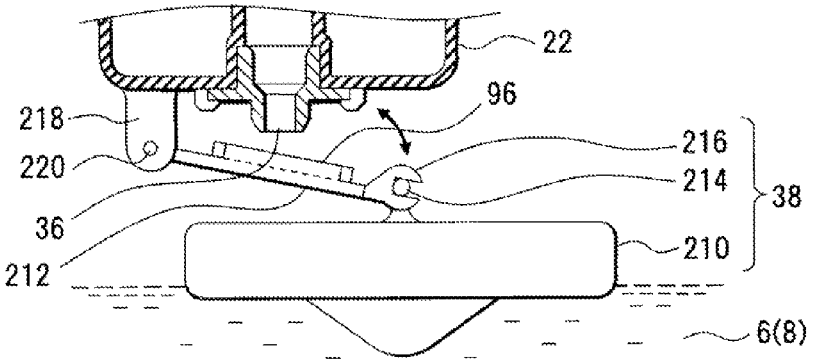

This second embodiment will be described with reference to FIGS. 16, 17A and 17B. FIG. 16 depicts an example of a structure of the valve according to the second embodiment, and FIGS. 17A and 178 depict opened and closed states of the valve. Each of the structures depicted in FIGS. 16, 17A and 17B is an example.

This valve 38 is an inflow control means for the drinking water 6 from the water outlet 36 to the cold water tank 8. The valve 38 is also an example of the above described convection suppressing means, and provides a float part 210 and an open and close unit 212. This valve 38 is opened and closed according to the level of the drinking water 6 in the cold water tank 8 as well as the above embodiment.

The float part 210 is an example of a control means for opening and closing the water outlet 36 with rising and falling according to the level of the drinking water 6 in the cold water tank 8. For example, an shaft 214 is provided for the top side of this float part 210 as depicted in FIG. 16. This shaft 214 is fitted into an shaft receiver 216 that is formed at one end of the open and close unit 212.

The open and close unit 212 forms part of the valve 38 for opening and closing the water outlet 36. The open and close unit 212 provides the above described packing 96 for its top side, which the water outlet 36 touches. One end of this open and close unit 212 is rotatably held by a fixing pin 220 in a fixing furniture 218 that is formed on the cover 22. Another end of the open and close unit 212 provides the shaft receiver 216 as described above, and is fitted into the shaft 214 of the float part 210 to hold the shaft 214 rotatably.

In such a structure, when the float part 210 rises according to the rise of the water level in the cold water tank 8 as depicted in FIGS. 17A and 17B, the shaft receiver 216 of the open and close unit 212 pivots on the fixed pin 220 to move upward. The upward movement of the shaft receiver 216 makes the packing 96 adhere to the water outlet 36, and stops supply of the drinking water 6 (FIG. 17A).

Fall of the water level in the cold water tank 8 makes the float part 210 and the shaft 214 fall. As well as the above, downward pivoting movement of the shaft receiver 216 of the open and close unit 212 releases the adhesion of the packing 96 to the water outlet 36 (FIG. 17B). Thereby, the air entering the cold water tank 8 from the air intake 102 blows from the water outlet 36 to the bottle 4, Thus, the drinking water 6 in the bottle 4 drips into the cold water tank 8.

The other structures or processing contents etc. of the drinking water dispenser 2 are the same as the above described embodiment, and thus the description thereof is omitted.

According to such a structure, as described above, an air layer is formed between the drinking water 6 in the cold tank 8 and the water outlet 36. Thus, the drinking water and its heat can be prevented from convecting. For example, in the normal driving, the temperature of the drinking water 6 in the cold tank 8 can be prevented from rising. Also, in the purification process, the drinking water 6 in the bottle 4 can be prevented from being heated.

Third Embodiment

A third embodiment is an example of a variation of the valve 38 for controlling the supply of the drinking water from the bottle 4 to the cold water tank 8. This embodiment depicts a case of using a float ball.

Figure 18A:
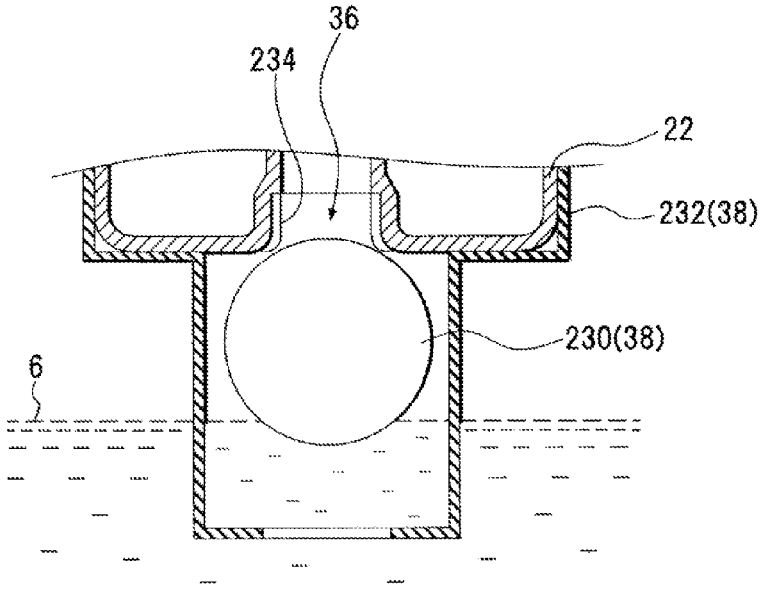
FIGS. 18A and 18B depict an example of a structure of a valve and its opened and closed states according to a third embodiment.
Figure 18B:
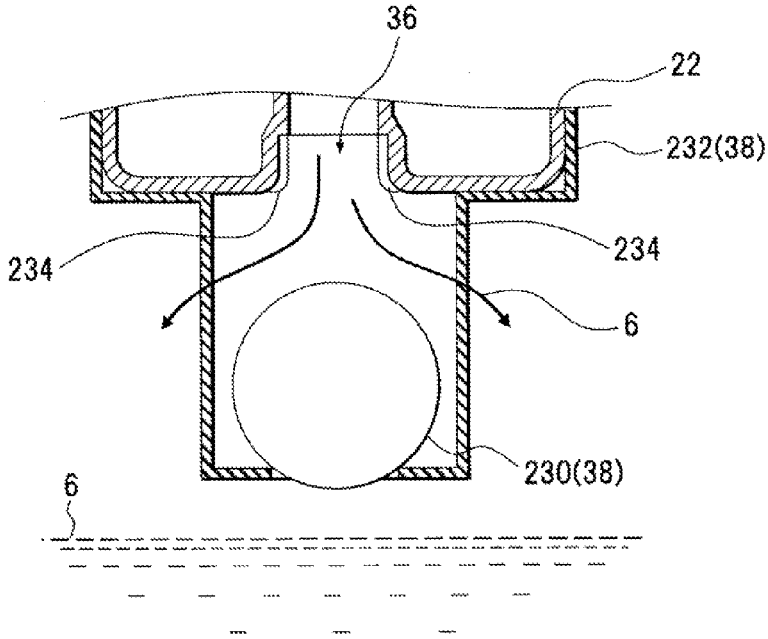

This third embodiment will be described with reference to FIGS. 18A and 18B. FIGS. 18A and 18B depict an example of a structure of the valve and its opened and closed states according to the third embodiment. Each structure depicted in FIGS. 18A and 18B is an example.

This valve 38 consists of a float ball 230 that rises and falls according to the water level of the cold water tank 8, and a float cover 232 that is placed on the cover 22. The float ball 230 is an integrated composition of the above described float part 94 and packing 96, for example. The float ball 230 rises or falls in the float cover 232.

If the water level in the cold water tank 8 rises, the float ball 230 rises. If the float ball 230 reaches a predetermined water level, its upper surface adheres to the water outlet 36. Thereby, the supply of the drinking water 6 is stopped (FIG. 18A). A packing 234 may be provided for the inside of this water outlet 36 in order to achieve better adhesion to the float ball 230.

If the water level of the cold water tank 8 falls, the float ball 230 falls, and the water outlet 36 is released to supply the drinking water 6 (FIG. 18B). In this time, the float ball 230 may be held by the float cover 232 in order that its rising position is prevented from shifting.

The other structure or processing contents etc. of the drinking water dispenser 2 are the same as the above embodiments, and thus the description thereof is omitted.

Fourth Embodiment

A fourth embodiment depicts a case of using a switching valve 240 that consists of a solenoid valve or the like as the valve 38 that opens and closes the water outlet 36.

Figure 19:
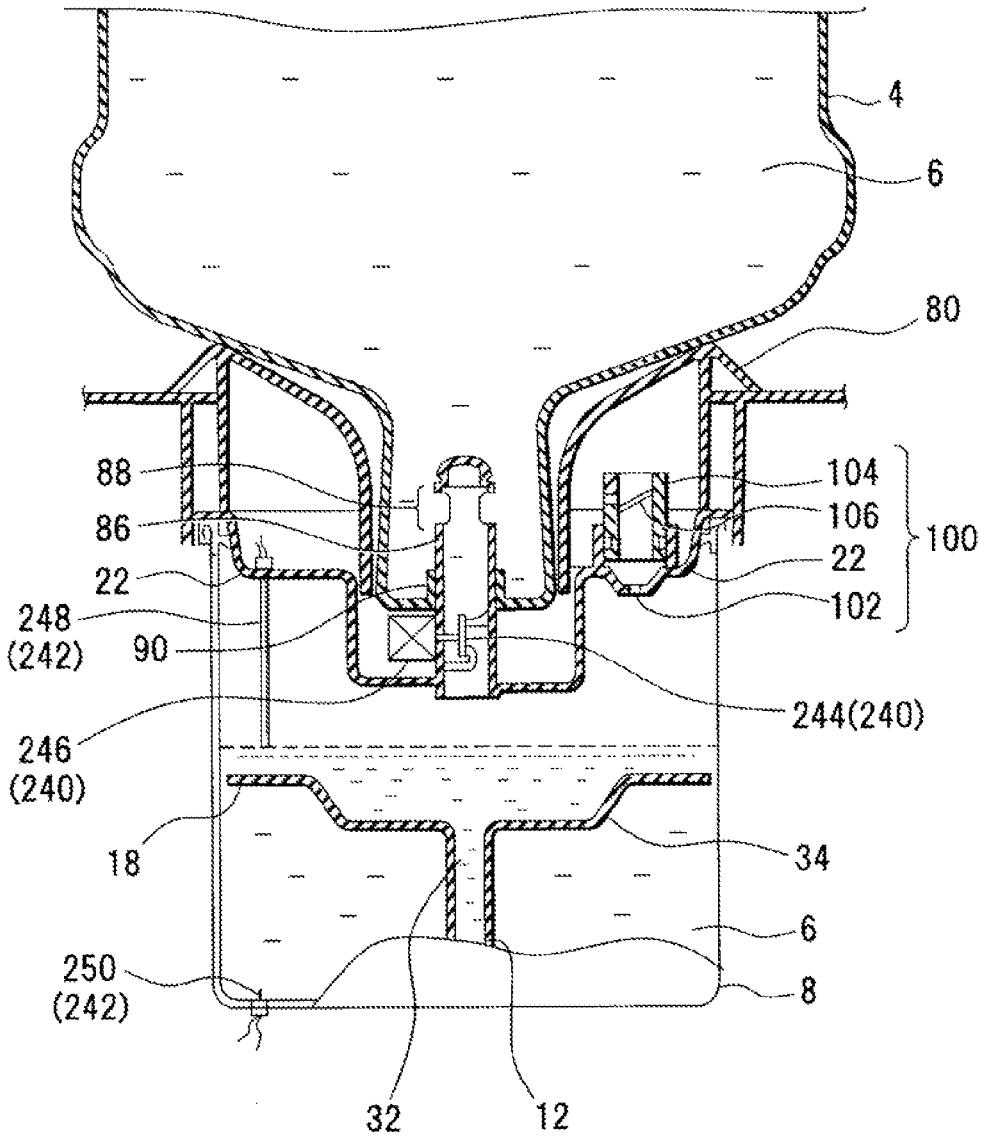
FIG. 19 depicts an example of a structure of a valve according to a fourth embodiment.

This fourth embodiment will be described with reference to FIG. 19. FIG. 19 depicts an example of a structure of the valve according to the fourth embodiment. The structure depicted in FIG. 19 is an example. The other structure or processing contents, etc. of the drinking water dispenser 2 are the same as the above embodiments, and thus the description thereof is omitted.

As described above, this valve 38 is an inflow control means for the drinking water 6 from the water outlet 36 to the cold water tank 8, and is also an example of a convection suppressing means. The valve 38 is formed by the switching valve 240 such as a solenoid valve, and performs its open and close control according to the water level in the cold water tank. This valve 38 includes the switching valve 240 and a water level detector 242, for example.

The switching valve 240 is an example of a means for opening and closing the water outlet 36. For example, open and close are switched by a solenoid valve or the like, For example, a valve disc 244 is placed inside the projection 86 that is a drinking water intake means. Driving instructions from the control device 72 is outputted to a drive unit 246 that consists of a solenoid and a motor, for example, to open and close the valve disc 244.

The water level detector 242 is an example of a means for detecting the level of the drinking water 6 in the cold water tank 8. For example, the water level detector 242 is attached to the cover 22 and the bottom of the cold water tank 8. An electrode 248 that is energized when a predetermined water level is reached is placed on the cover 22. A common electrode 250 of the water level detector 242 is also placed on the bottom of the cold water tank 8. If it is detected that a predetermined water level is reached, this result is informed to the control device 72.

If the water level detector 242 is OFF (water level is not reached), the switching valve 240 is into an opened state to supply water. If the water level of the cold water tank 8 rises and the water level detector 242 is turned ON, the switching valve 240 is into a closed state to cut off water.

Features are listed as follows concerning the above described embodiments.

(1) The drinking water dispenser of the present invention cools or heats the drinking water 6 that is supplied by the bottle 4. Thus, the cooled drinking water 6 and the heated drinking water can be dispensed by a single device.

(2) Concerning the purification process of the drinking water dispenser 2 that cools and heats the drinking water 6, the purification of the drinking water 6 can be efficiently performed with a simple structure using the drinking water 6 of heated hot water. It is also possible not to mix the heated drinking water 6 in the cold water tank 8 and the drinking water 6 in the bottle 4.

(3) The drinking water dispenser 2 where the bottle 4 is placed and which cools the drinking water 6 supplied from the bottle 4 to provide cold water or heats the drinking water 6 to provide hot water includes the cold water tank 8 that is a first tank, a cooling means, a separating plate, a hot water tank 10 that is a second tank, a heating means, a water supply pipe, a cold water detector 20 that is a first temperature detecting means, a hot water detector 60 that is a second temperature detecting means, a by-pass pipe, a convection suppressing means and a control means. The first tank stores drinking water supplied from the bottle. The cooling means cools the drinking water in the first tank. The separating plate 18 is placed in the first tank to separate the drinking water in the first tank into an upper layer and a lower layer. The second tank is arranged below the first tank to store the drinking water 6 supplied from the bottle 4. The heating means heats the drinking water 6 in the second tank. The water supply pipe 12 has an opening in the upper face of the separating plate, is inserted into the second tank, and supplies the drinking water that drips from the water outlet 36 to the separating plate, into the second tank. The first temperature detecting means detects the temperature of the drinking water 6 in the first tank. The second temperature detecting means detects the temperature of the drinking water 6 in the second tank. The by-pass pipe 16 is placed between the first tank and the second tank, and provides an open and close valve. The convection suppressing means opens and closes the water outlet 36 according to the water level of the first (cold water) tank, and suppresses convection of the cold or hot water to the bottle. The control means stops the cooling means in the purification process, operates the heating means, opens the open and close valve, and controls the temperature of hot water, which circulates in the first and second tanks via the by-pass pipe and the water supply pipe, under a predetermined temperature or over to circulate the hot water in a direction from the second (hot water) tank to the first (cold water) tank.

(4) The convection suppressing means is a float, and moves upward and downward according to the water level of the first tank. If the water level rises, the float is held at the water outlet 36 to shut the water outlet 36 using the surface tension of water and buoyancy that operates on the float as retention. An air layer is formed between the water outlet 36 and the water surface of the first tank of the full water level. This air layer separates water in the water outlet 36 and water in the first tank to prevent thermal convection between the first tank and the bottle.

(5) The convection suppressing means is a ball tap that moves upward and downward according to the water level of the first tank, and that opens and closes the water outlet.

(6) The convection suppressing means is an open and close valve. The convection suppressing means is structured so that the water level of the cold water tank is detected by the water level detector; and the open and close valve is opened if the water level detector is OFF, and is closed if the water level of the first tank rises and the water level detector is turned ON, (7) The purification of the drinking water can be performed using the drinking water of hot water as high-temperature water with heating the drinking water of hot water.

(8) Concerning the drinking water dispenser that dispenses cold water or hot water, convection between cold water and the bottle can be suppressed, and the inconvenience such that cold water in the cold water tank or high-temperature water in the purification is mixed into water in the bottle can be prevented.

(9) In the purification, the inside of the cold water tank is heated by the drinking water heated in the hot water tank. Since thermal transmission to the drinking tank can be surely blocked even if remaining air expands or is compressed, leaking water due to erroneous operation can be prevented.

(10) An air layer can be formed in the cold water tank with block of the water outlet with the separator, to suppress thermal transmission or heating by hot water. Because a passage to the drinking tank is blocked, the air can be discharged or absorbed through the air intake.

(11) The temperature of the drinking water 6 in the cold water tank 8 can be maintained proper to the purification with a simple structure. If a necessary temperature is not reached even if predetermined time has passed, it is informed that there is an anomaly in the process of the purification. Thus, a sufficient purification process can be performed.

(12) A disconnecting device (separator float 14 having buoyancy) is provided. The drinking water 6 is supplied to the cold water tank 8, and the separator float 14 rises as the water level in the cold water tank 8 rises to block the water outlet 36 that is a supply part. Thereby, it is ultimately suppressed to raise the water temperature in the bottle 4 and to expand an air layer due to thermal convection that influences even the bottle 4 when the inside of the cold water tank 8 is heated through high-temperature circulation.

(13) According to the above structure, a driving device such as a pump is not needed for high-temperature water circulation, and a complex control circuit can be prevented. Generating driving noise and much electricity consumption can be also prevented. Thermal influence on a gallon bottle at the same time when the inside of the cold water tank is heated can also be prevented in high-temperature circulation.

(14) There is a problem that the separator float 14 does not fall due to the surface tension although the water level in the cold water tank 8 falls. Enlarging the shape of the float makes its weight heavier, which can ensure the fall of the float.

(15) A high-temperature circulation function can be more efficient using for the air intake unit 100 of the bottle 4, the small mesh filter 106, such as a membrane filter, through which dusts in the air cannot pass.

Figure 20:
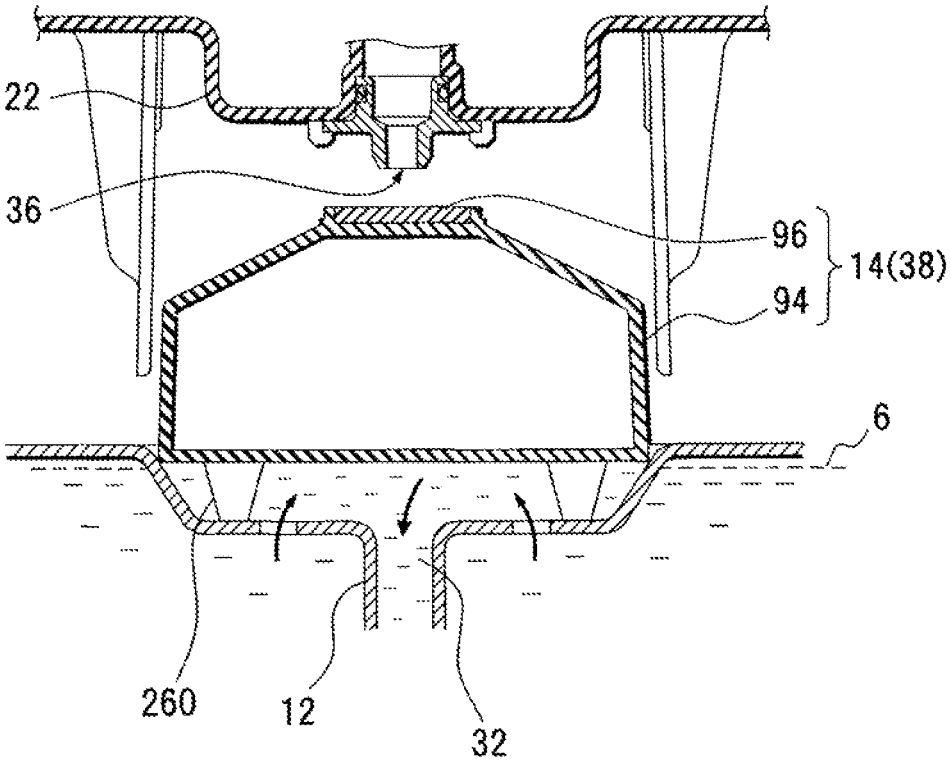
FIG. 20 depicts an example of a structure of a separator float according to another embodiment.

Other Embodiment (1) In the above embodiments, the separator float 14 falls according to the fall of the level of the drinking water 6 stored in the cold water tank 8, and, for example, when touching the separating plate 18, the separator float 14 is regarded as falling to the lowest position. The invention is not limited to this. For example, as depicted in FIG. 20, legs 260 may be provided for the bottom of the float part 94. If the separator float 14 falls at a predetermined water level, these legs 260 touches the separating plate 18. Thereby, for example, if the separator float 14 falls, it can be prevented that the opening 32 that introduces the drinking water 6 to the hot water tank 10 is shut, and the supply of the drinking water 6 is not to be interrupted.

Following effects can be obtained according to the drinking water dispenser of the present disclosure.

(1) Drinking water in the cold water tank, and drinking water of high-temperature in the purification and heat thereof are not convected to the bottle so that no temperature change is generated in drinking water stored in the bottle.

(2) The temperature of drinking water circulating in the purification process is prevented from lowering by convection between heated drinking water and drinking water in the bottle. Thus, a purification function for drinking water cannot deteriorate.

(3) Heat of heated drinking water is not transmitted to the bottle. Thus, it can be prevented that drinking water leaks due to erroneous operation at the water outlet by the expansion or compression of the air in the bottle.

The drinking water dispenser of the present disclosure has been described above. The above description is not intended to limit the present invention. It is apparent that various modifications or alterations may be made by those who skilled in art, based on the substance that is described in claims or disclosed in Detailed Description of the Invention. It is also obvious that such modifications or alterations are included in the scope of the present invention.

The drinking water dispenser of the present disclosure prevents the temperature of drinking water in a bottle from changing by controlling the supply of the drinking water from the bottle according to the level of the stored drinking water and by providing a valve that forms an air layer between drinking water in the tank and drinking water in the bottle. Also, the device can prevent the temperature of circulating drinking water in the purification process from lowering. Thus, the device is useful because not making the purification function of drinking water deteriorate, etc.

What is claimed is:

1. A drinking water dispenser that heats and cools drinking water supplied from a water supply bottle, and provides heated and cooled drinking water, the dispenser comprising:

a cold water tank that cools the drinking water fit to drink to store the cooled drinking water;

a hot water tank that heats the drinking water to store the heated drinking water;

a water supply pipe that is provided to a recessed portion of a plate member, the plate member being disposed in the cold water tank, the water supply pipe introducing the drinking water stored in the cold water tank, to the hot water tank;

a valve that opens and closes a water outlet for taking in the drinking water from the water supply bottle according to a level of the drinking water in the cold water tank, the water outlet being disposed in a cover, the cover being placed on the cold water tank, the valve limiting supply of the drinking water to the cold water tank, and suppressing convection of the drinking water and/or heat of the drinking water between the water supply bottle and the cold water tank while the water outlet is shut;

a by-pass pipe that is between the hot water tank and the cold water tank, to circulate the heated drinking water in the hot water tank and the cold water tank along with the water supply pipe;

a by-pass valve that blocks the by-pass pipe; and a control unit that controls open and close of the by-pass valve while there is no provision request of the drinking water and while the valve is shut, wherein the valve includes a float part and an open and close unit, the float part rising toward an opening of the water outlet and falling according to the level of the drinking water in the cold water tank, the open and close unit including packing that opens and closes the water outlet, one end of the open and close unit being rotatably supported by the float part, another end of the open and close unit being supported at a side of the water outlet, wherein the float part floats on a surface of the drinking water by receiving buoyancy from the drinking water and is movably exposed on the surface of the drinking water, the float part including a first part supported with one end of the open and close unit and a second part protruding downward from the first part, wherein the first part of the float part touches the plate member so to allow the second part of the float part to escape into the recessed portion of the plate member when the float part is falling, and wherein the packing is adhered to the water outlet by rise of the float part, or adhesion of the packing is released by fall of the float part, and the water outlet is opened and closed by the packing.

2. The drinking water dispenser of claim 1, further comprising:

cooling means that is placed on the cold water tank, and cools the drinking water;

heating means that is placed on the hot water tank, and heats the drinking water;

cold water temperature detecting means that detects a temperature of the drinking water in the cold water tank; and hot water temperature detecting means that detects a temperature of the drinking water in the hot water tank, wherein when the drinking water is circulated, the control unit stops the cooling means and operates the heating means to heat the drinking water to a predetermined temperature or over.

3. The drinking water dispenser of claim 1, further comprising:

a separating plate that includes the plate member, the separating plate separating the drinking water in the cold water tank into an upper layer side and a lower layer side, wherein the water supply pipe is connected to an opening of the separating plate, and makes the drinking water, that falls onto the separating plate from the water outlet, flow to the hot water tank.

4. The drinking water dispenser of claim 1, further comprising:

cooling means that is provided for the cold water tank, and cools the drinking water;

heating means that is provided for the hot water tank, and heats the drinking water;

cold water temperature detecting means that detects a temperature of the drinking water in the cold water tank; and hot water temperature detecting means that detects a temperature of the drinking water in the hot water tank, wherein when the drinking water is circulated, the control unit stops the cooling means and operates the heating means to heat the drinking water.

5. The drinking water dispenser of claim 1, wherein an air layer is formed between the water outlet and a water surface of the cold water tank of a full level.

6. The drinking water dispenser of claim 1, further comprising:

an air intake unit that includes a filter, and takes in air from an outside to the cold water tank through the filter.

7. A drinking water dispenser that heats and cools drinking water supplied from a water supply bottle, and provides heated and cooled drinking water, the dispenser comprising:

a cold water tank that cools the drinking water fit to drink to store the cooled drinking water;

a hot water tank that heats the drinking water to store the heated drinking water;

a water supply pipe that is provided to a recessed portion of a plate member, the plate member being disposed in the cold water tank, the water supply pipe introducing the drinking water stored in the cold water tank, to the hot water tank;

a valve that opens and closes a water outlet for taking in the drinking water from the water supply bottle according to a level of the drinking water in the cold water tank, the water outlet being disposed in a cover, the cover being placed on the cold water tank;

a by-pass pipe that is between the hot water tank and the cold water tank, to circulate the heated drinking water in the hot water tank and the cold water tank along with the water supply pipe;

a by-pass valve that blocks the by-pass pipe; and a control unit that controls open and close of the by-pass valve while there is no provision request of the drinking water and while the valve is shut, wherein the valve includes a float part that rises toward an opening of the water outlet and falls according to the level of the drinking water in the cold water tank, wherein the cover includes a guide that guides rise and fall of the float part, the guide having an opening at a bottom of the guide, the opening of the guide being larger than a maximum width of the float part, wherein at least part of the float part passes through the opening of the guide when the float part is falling, and wherein the recessed portion of the plate member is formed so to allow at least part of the float part to escape thereinto when the float part is falling.

8. The drinking water dispenser of claim 7, wherein the recessed portion of the plate member forms a niche for escape of the float part, when the float part has fallen, and wherein the valve is supported by the recessed portion of the plate member.

9. The drinking water dispenser of claim 7, wherein the float part is provided with a leg, and the float part can be supported on the plate member by the leg.

10. The drinking water dispenser of claim 7, wherein an opening of the recessed portion of the plate member is larger than an opening of the guide.

11. The drinking water dispenser of claim 7, wherein the guide has lattice through which the drinking water passes.

* * * * *